US009458403B2

(12) United States Patent
Patil et al.

(10) Patent No.: US 9,458,403 B2
(45) Date of Patent: Oct. 4, 2016

(54) HIGH VISCOSITY, FUNCTIONALIZED METALLOCENE POLYALPHAOLEFIN BASE STOCKS AND PROCESSES FOR PREPARING SAME

(71) Applicant: ExxonMobil Research and Engineering Company, Annandale, NJ (US)

(72) Inventors: Abhimanyu Onkar Patil, Westfield, NJ (US); Shuji Luo, Bridgewater, NJ (US); Satish Bodige, Wayne, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 474 days.

(21) Appl. No.: 14/017,826

(22) Filed: Sep. 4, 2013

(65) Prior Publication Data

US 2014/0087986 A1 Mar. 27, 2014

Related U.S. Application Data

(60) Provisional application No. 61/706,279, filed on Sep. 27, 2012.

(51) Int. Cl.
*C10M 133/12* (2006.01)
*C10M 135/22* (2006.01)
(Continued)

(52) U.S. Cl.
CPC ..... *C10M 107/46* (2013.01); *C10M 107/42* (2013.01); *C10M 107/40* (2013.01);
(Continued)

(58) Field of Classification Search
CPC ..... C10M 2215/064; C10M 2219/082; C07C 319/00; G03G 5/0614
USPC ..... 508/563, 569; 568/59; 564/433
See application file for complete search history.

(56) References Cited

U.S. PATENT DOCUMENTS 3,576,923 A 4/1971 Randell et al.
4,234,435 A 11/1980 Meinhardt et al.
(Continued)

FOREIGN PATENT DOCUMENTS

WO 2007011462 A1 1/2007

OTHER PUBLICATIONS

"Diamines and Higher Amines, Aliphatic", Encyclopedia of Chemical Technology, Second Edition, Kirk-Othmer, Interscience Publishers (a division of John Wiley & Sons), 1965, vol. 7, pp. 27-39.

*Primary Examiner* — Vishal Vasisth
(74) *Attorney, Agent, or Firm* — Robert A. Migliorini

(57) ABSTRACT

A process for producing a high viscosity functionalized metallocene polyalphaolefin (mPAO) fluid. The process includes providing a mPAO having a terminal double bond, said mPAO produced by the metallocene-catalyzed oligomerization or polymerization of an alpha-olefin feed; providing at least one of a substituted or unsubstituted alkyl thiol, aryl thiol, diphenylamine or naphthalene; and reacting, optionally in the presence of a catalyst or initiator, the mPAO having a terminal double bond with at least one of the substituted or unsubstituted alkyl thiol, aryl thiol, diphenylamine or naphthalene, under reaction conditions sufficient to produce the functionalized high viscosity mPAO fluid. The functionalized mPAO fluid has, as synthesized, a viscosity ($Kv_{100}$) from 135 to 900 cSt at 100° C.; a viscosity index (VI) greater than 150; a pour point (PP) less than −25° C.; a molecular weight distribution (Mw/Mn) less than 2.0; a residual unsaturation (Bromine Number) less than 2.0; and a glass transition temperature $T_g$ less than −30° C.

20 Claims, 3 Drawing Sheets

(51) Int. Cl.

| | |
|---|---|
| ***C07C 381/00*** | (2006.01) |
| ***C07C 211/00*** | (2006.01) |
| ***C10M 107/46*** | (2006.01) |
| ***C10M 107/42*** | (2006.01) |
| *C10M 177/00* | (2006.01) |
| *C10M 107/40* | (2006.01) |
| *C10M 107/44* | (2006.01) |

(52) U.S. Cl.

CPC ..... *C10M107/44* (2013.01); *C10M 177/00* (2013.01); *C10M 2205/0285* (2013.01); *C10M 2217/065* (2013.01); *C10M 2221/0405* (2013.01); *C10N 2220/021* (2013.01); *C10N 2220/022* (2013.01); *C10N 2230/10* (2013.01); *C10N 2260/09* (2013.01); *C10N 2260/10* (2013.01)

(56) References Cited

U.S. PATENT DOCUMENTS

| | | | | |
|---|---|---|---|---|
| 4,263,150 | A | 4/1981 | Clason et al. | |
| 4,289,635 | A | 9/1981 | Schroeck | |
| 4,308,154 | A | 12/1981 | Clason et al. | |
| 4,417,990 | A | 11/1983 | Clason et al. | |
| 4,827,073 | A | 5/1989 | Wu | |
| 2009/0270296 | A1* | 10/2009 | Patil ..... | C07C 37/14 508/591 |

* cited by examiner

Fig. 3

| Examples | Fluid | mPAO | $Kv_{100}$ | Br # Before | Br # After | DSC Oxi. Tonset (mPAO) | DSC Oxi. Tonset (mPAO-S) |
|---|---|---|---|---|---|---|---|
| Example 1 | mPAO-S (26204-3) | 26008-49 | 336 | 2.77 | 1.06 | 195.4 | 242.3 |
| Example 2 | mPAO-S (26204-4) | 25906-26 | 636 | 2.43 | 1.13 | 188.8 | 233.3 |
| Example 3 | mPAO-S (26204-6) | 25906-25 | 1089 | 1.87 | 1.17 | 190.4 | 224.1 |
| Example 4 | mPAO-DPA (26232-13) | 26008-49 | 336 | - | - | 195.4 | 224.0 |

HIGH VISCOSITY, FUNCTIONALIZED METALLOCENE POLYALPHAOLEFIN BASE STOCKS AND PROCESSES FOR PREPARING SAME

CROSS-REFERENCE TO RELATED APPLICATIONS

This application claims priority to U.S. Provisional Application Ser. No. 61/706,279 filed Sep. 27, 2012, herein incorporated by reference in its entirety.

FIELD

This disclosure relates to high viscosity, functionalized metallocene polyalphaolefin (mPAO) fluids useful as lubricating oil base stocks or co-base stocks, lubricating oils derived therefrom, and processes for preparing same. The high viscosity functionalized mPAO fluids exhibit oxidative stability and can be prepared without the need for hydrogenation. The functionalized mPAO fluids have low residual unsaturation (Bromine Number <2.0).

BACKGROUND

Lubricants in commercial use today are prepared from a variety of natural and synthetic base stocks admixed with various additive packages depending upon their intended application. The base stocks typically include mineral oils, polyalphaolefins (PAO), gas-to-liquid base oils (GTL), silicone oils, phosphate esters, diesters, polyol esters, and the like.

A major trend for industrial engine oils is an overall improvement in quality as higher quality base stocks become more readily available. Typically the highest quality industrial products are formulated with base stocks such as PAOs or GTL stocks.

One problem facing producers of high viscosity index PAOs is that of reducing the unsaturation of the as-polymerized carbon chains of the PAO products, which can be quantified by Bromine Number (ASTM D1159). A PAO fluid cannot be satisfactorily used as a lubricant base stock if its Bromine Number exceeds 3. The unsaturation indicated by higher Bromine Number can result in poor oxidative stability and poor high temperature stability of the PAO molecules. Accordingly, it is typical to hydrogenate these as-polymerized PAO products in order to reduce the level of unsaturation in the molecules, so as to render them suitable for use as lubricant base stocks. WO 2007/011462 discloses post-polymerization hydrogenation in order to produce a PAO having a Bromine Number of less than 2. Current commercial high viscosity PAOs, such as PAO100 and PAO150, are hydrogenated to improve the oxidative stability of the base stocks.

The hydrogenation step is expensive and is difficult for thicker materials such as fluids above viscosity of 300 cSt at 100° C. In addition, terminal unsaturation present in as-polymerized PAOs can lead to oxidation and degradation of the product. There is an unmet need in the art to optimize the polymerization reaction and functionalization process for producing functional PAOs, so as to avoid the need for expensive, post-polymerization hydrogen finishing, such that the functional PAO product is suitable for use as a lubricant base stock.

Further, there is a need for high viscosity (300-900 cSt at 100° C.) fluids for industrial lubes. There is a need for very high viscosity products (300-900 cSt at 100° C.) with very high viscosity index (VI), low pour points and fluids with narrow molecular weight distribution and high oxidative stability. The present disclosure provides solutions to these problems, which shall become apparent as described below.

SUMMARY

This disclosure relates in part to the preparation of functionalized mPAO fluids having high viscosity (300-900 cSt at 100° C.), high viscosity index (VI), low pour points, narrow molecular weight with terminal unsaturation. The fluids can be used as synthetic base stocks or co-base stocks for lubes, especially for industrial lubes. The fluids have following physical properties. The fluid has high viscosity ($Kv_{100}$ 300-900 cSt) with high viscosity index (VI) (>150), low pour points (PP) (<−25° C.), narrow molecular weight distribution (<2.0), low residual unsaturation (Bromine Number <2.0), low glass transition temperature $T_g$ (<−30° C.), no crystallization peak as measured by differential scanning calorimetry, and high thermal stability.

In accordance with this disclosure, high viscosity, functionalized mPAO fluids with very high VI and very low pour points can be prepared. These fluids also have superior oxidative stability, superior shear stability and superior low temperature properties. Furthermore, the high viscosity, functionalized mPAO fluids have low residual unsaturation (Bromine Number <2.0) as functionalized.

This disclosure relates in part to a process for the preparation of oxidatively stable high viscosity, functionalized mPAO ($Kv_{100}$: >135 cSt) base stocks. Unlike prior art processes, the process of this disclosure does not require a hydrogenation step. Two approaches have been developed to obtain oxidatively stable basestocks, namely: 1) the reaction of a substituted or unsubstituted alkyl or aryl thiol with mPAO having terminal unsaturation, and 2) alkylation reaction of a substituted or unsubstituted diphenylamine or naphthalene with mPAO having terminal unsaturation. Both of these functionalization reactions convert oxidatively unstable double bond into stable molecule. Besides improving oxidative stability, these functionalization reactions can improve shear stability of the fluid.

In particular, this disclosure further relates in part to a process for producing a functionalized metallocene polyalphaolefin (mPAO) fluid. The process comprises: providing a mPAO having a terminal double bond, said mPAO produced by the metallocene-catalyzed oligomerization or polymerization of an alpha-olefin feed; providing at least one of a substituted or unsubstituted alkyl thiol, aryl thiol, diphenylamine or naphthalene; and reacting, optionally in the presence of a catalyst or initiator, the mPAO having a terminal double bond with at least one of the substituted or unsubstituted alkyl thiol, aryl thiol, diphenylamine or naphthalene, under reaction conditions sufficient to produce the functionalized mPAO fluid. The functionalized mPAO fluid has, as synthesized, a viscosity ($Kv_{100}$) from 135 to 900 cSt at 100° C.; a viscosity index (VI) greater than 150; a pour point (PP) less than −25° C.; a molecular weight distribution (Mw/Mn) less than 2.0; a residual unsaturation (Bromine Number) less than 2.0; and a glass transition temperature $T_g$ less than −30° C.

In particular, this disclosure also relates in part to a method for improving oxidative stability of a metallocene polyalphaolefin (mPAO) fluid. The method comprises: providing a mPAO having a terminal double bond, said mPAO produced by the metallocene-catalyzed oligomerization or polymerization of an alpha-olefin feed; providing at least one of a substituted or unsubstituted alkyl thiol, aryl thiol, diphenylamine or naphthalene; and reacting, optionally in the presence of a catalyst or initiator, the mPAO having a terminal double bond with at least one of the substituted or unsubstituted alkyl thiol, aryl thiol, diphenylamine or naphthalene, under reaction conditions sufficient to produce a functionalized mPAO fluid. The functionalized mPAO fluid has, as synthesized, a viscosity ($Kv_{100}$) from 135 to 900 cSt at 100° C.; a viscosity index (VI) greater than 150; a pour point (PP) less than −25° C.; a molecular weight distribution (Mw/Mn) less than 2.0; a residual unsaturation (Bromine Number) less than 2.0; and a glass transition temperature $T_g$ less than −30° C.

This disclosure also relates in part to functionalized metallocene polyalphaolefin (mPAO) fluids comprising a polymer of one or more $C_8$ to $C_{12}$ alphaolefin monomers that has been reacted with at least one of (i) a substituted or unsubstituted alkyl or aryl thiol (i.e., reacts with terminal unsaturation of the mPAO) and (ii) a substituted or unsubstituted diphenylamine or naphthalene (i.e., alkylation reaction with terminal unsaturation of the mPAO). The functionalized mPAO has: a viscosity ($Kv_{100}$) from 300 to 900 cSt at 100° C.; a viscosity index (VI) greater than 150; a pour point (PP) less than −25° C.; a molecular weight distribution (Mw/Mn) less than 2.0 as synthesized; a residual unsaturation (Bromine Number) less than 2.0 as synthesized; and a glass transition temperature $T_g$ less than −30° C.

This disclosure further relates in part to functionalized metallocene polyalphaolefin (mPAO) fluid prepared by the process of this disclosure.

This disclosure yet further relates in part to functionalized metallocene polyalphaolefin (mPAO) fluids which comprise lubricating oil base stocks or co-base stocks.

This disclosure also relates in part to functionalized metallocene polyalphaolefin (mPAO) base stocks or co-base stocks prepared by the process of this disclosure.

This disclosure further relates in part to lubricating oils comprising (i) a base stock comprising the functionalized metallocene polyalphaolefin (mPAO) base stock of this disclosure, or (ii) a conventional base stock and a co-base stock, wherein the co-base stock comprises the functionalized metallocene polyalphaolefin (mPAO) base stock of this disclosure.

This disclosure yet further relates in part to functionalized metallocene polyalphaolefin (mPAO) fluids of this disclosure which have an oxidative stability, as determined by Pressure Differential Scanning Calorimetry (PDSC), at least 1.10× greater than oxidative stability of an as synthesized mPAO that has not been hydrogenated.

The functionalized mPAO fluids of this disclosure have very high viscosity (300-900 cSt at 100° C.) with very high VI, low pour points and fluids with narrow molecular weight distribution and high shear stability. The high viscosity, functionalized mPAO fluids also have superior oxidative stability, high thermal stability, superior shear stability, and superior low temperature properties. The high viscosity, functionalized mPAO fluids have low residual unsaturation (Bromine Number <2.0) as synthesized.

In accordance with this disclosure, it has been surprisingly found even very high viscosity mPAO can be functionalized with diphenylamine or naphthalene using alkylation chemistry or can be reacted under mild conditions with thiols to obtain stable fluid without the need for hydrogenation.

The functionalized mPAOs produced by the process of this disclosure preferably have a Bromine Number of 1.8 or less as measured by ASTM D 1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5. In accordance with this disclosure, hydrogenation of the mPAOs is not required to obtain the above Bromine Numbers.

The process of the present disclosure affords a number of advantages. They include, for example, the following: (1) the functionalized mPAO product does not need an additional hydrogenation step to obtain oxidative stability; (2) the reaction can be carried out at a high conversion level due to the presence of the terminal double bond in the mPAO; and (3) the functionalized mPAO product can be used as multifunctional fluid with both basestock and antioxidant properties.

Further objects, features and advantages of the present disclosure will be understood by reference to the following drawings and detailed description.

BRIEF DESCRIPTION OF THE DRAWINGS

To assist those of ordinary skill in the relevant art in making and using the subject matter hereof, reference is made to the appended drawings, wherein:

FIG. 3 is a table that includes data generated from Examples 1-4 herein below.

DETAILED DESCRIPTION

Figure 1:
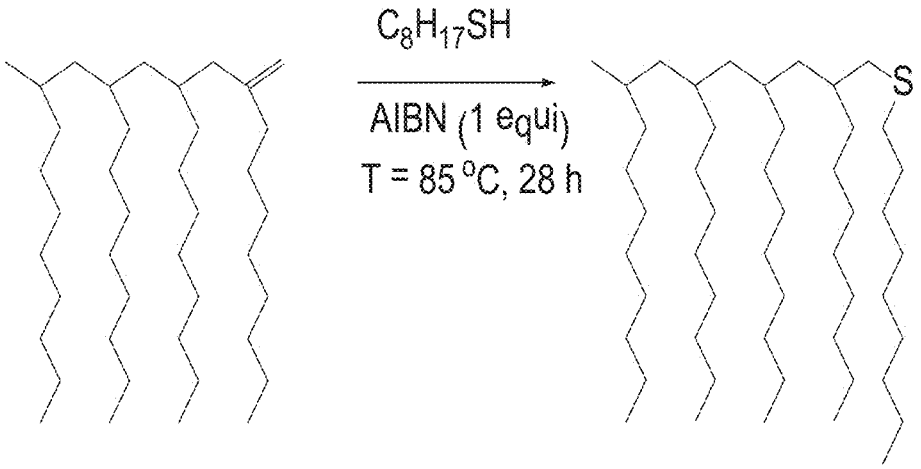
FIG. 1 depicts the reaction of a high viscosity mPAO with an alkyl thiol.

All numerical values within the detailed description and the claims herein are modified by "about" or "approximately" the indicated value, and take into account experimental error and variations that would be expected by a person having ordinary skill in the art. Unless otherwise stated all pressures in psi are psig and all molecular weights are g/mol.

For purposes of this disclosure and the claims thereto, a polymer is referred to as comprising homopolymers and copolymers, where copolymers include any polymer having two or more chemically distinct monomers. Likewise, an oligomer is referred to as comprising homooligomers and cooligomers, where cooligomers include any oligomer having two or more chemically distinct monomers.

For the purposes of this disclosure and the claims thereto the term "polyalphaolefin" or "PAO" includes homopolymers and copolymers of $C_3$ or greater alphaolefin monomers.

For purposes of this disclosure and the claims thereto, a designated fraction of the product obtained as a PAO may be referred to as 'lube', 'lube fluid' or 'lube fraction'.

Functionalized mPAOs

The high viscosity, functionalized metallocene polyalphaolefins (mPAOs) of this disclosure comprise one or more $C_8$ to $C_{12}$ monomers. The functionalized mPAOs have a viscosity ($Kv_{100}$) from 300 to 900 cSt at 100° C.; a viscosity index (VI) greater than 150; a pour points (PP) less than −25° C.; a molecular weight distribution (Mw/Mn) less than 2.0 as synthesized; a residual unsaturation (Bromine Number) less than 2.0; and a glass transition temperature $T_g$ less than −30° C. The functionalized mPAOs further have oxidative stability and high thermal stability.

The functionalized mPAOs produced in accordance with the process of this disclosure possess high viscosity, low pour points and superior oxidative stability, shear stability, and low temperature properties. Furthermore, the high viscosity, functionalized mPAOs of this disclosure have low Bromine Number (low residual double bonds or unsaturation) and no crystalline peak but only low glass-transition temperature peak as measured by differential scanning calorimetry (DSC).

The functionalized mPAOs have a high viscosity ($Kv_{100}$) from 300 to 900 cSt at 100° C., preferably from 350 to 850 cSt at 100° C., and more preferably from 400 to 800 cSt at 100° C. The functionalized mPAOs have a viscosity index (VI) greater than 150, preferably greater than 200, and more preferably greater than 250. As used herein, viscosity ($Kv_{100}$) is determined by ASTM D 445-01, and viscosity index (VI) is determined by ASTM D 2270-93 (1998).

In another embodiment according to the present disclosure, any functionalized mPAO described herein may have a kinematic viscosity (Kv) at 100° C. in any of the following ranges: from 100 to 1,000 cSt, from 250 to 950 cSt, from 300 cSt to 900 cSt, from 400 cSt to 800 cSt, wherein all values are measured by ASTM D445-01.

The functionalized mPAOs of this disclosure have a high viscosity index and a $Kv_{100}$ of 300 cSt or more, alternatively 350 cSt or more, alternatively 400 cSt or more, up to 900 cSt, with a VI of 200 or more, alternatively 220 or more, alternatively 250 or more. Usually base stock VI is a function of fluid viscosity. Usually, the higher the VI, the better it is for lube application. Base stock VI also depends on feed composition. Fluids made from single 1-octene, 1-nonene, 1-decene, or 1-dodecene have excellent VI and good low pour point. Fluids made from two or more olefins selected from $C_8$ to $C_{12}$ alphaolefins generally have excellent high VI and superior low pour points if the average carbon chain length of feed LAOs is kept within 8 to 12 carbons. A relatively much lower average chain length in the feed (much below 6 carbons) of the mixed LAO would result in lower VI. Too high of an average chain length in the feed (much above 12 carbons) of the mixed LAO would result in very high pour point, around room temperature.

In another embodiment according to the present disclosure, any functionalized mPAO described herein has a viscosity index (VI) of 150 or more, or 200 or more, or 220 or more. Viscosity index is determined according to ASTM Method D2270-93 [1998].

The functionalized mPAOs produced in accordance with the process of this disclosure have low residual unsaturation (Bromine Number) less than 2.0, preferably less than 1.75, and more preferably less than 1.5, as synthesized. As used herein, Bromine Number is determined by ASTM D 1159.

In a preferred embodiment, the Bromine Number of the functionalized mPAOs of this disclosure is less than 2 or more preferably less than 1.5. Lower Bromine Number indicates higher degree of saturation, which is usually indicative of higher oxidative stability and high quality of base stock. Bromine Number is measured by ASTM D1159.

In another embodiment, any of the functionalized mPAOs produced herein preferably have a Bromine Number of 1.8 or less as measured by ASTM D1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less.

The functionalized mPAOs have an oxidative stability, as determined by Pressure Differential Scanning Calorimetry (PDSC), at least 1.10× greater, preferably at least 1.15× greater, and more preferably at least 1.20× greater, than oxidative stability of an as synthesized mPAO that has not been hydrogenated.

In another embodiment according to the present disclosure, any functionalized mPAOs described herein may have a kinematic viscosity at 100° C. from 300 to 900 cSt and a flash point of 150° C. or more, preferably 200° C. or more (as measured by ASTM D56).

The high viscosity, functionalized mPAOs of this disclosure are desirable for use as lubricating oil base stocks and also blend stocks with API Groups I to V or gas-to-liquid (GTL) derived lube base stocks for use in industrial and automotive engine or gear oil, especially certain high $Kv_{100}$ grades of 300 to 900 cSt which are especially desirable for use as lubricating oil base stocks or blend stocks with Groups I to V or GTL-derived lube base stocks for use in industrial and automotive engine or gear oil.

These higher viscosity, functionalized mPAOs can be used as lubricating oil base stocks and also superior blend stocks. They can be blend stocks with any of the API Group I to V and GTL fluids to give the optimum viscometrics, solvency, high and low temperature lubricity, and the like. The functionalized mPAOs can be further blended with proper additives, including antioxidants, antiwear additives, friction modifiers, dispersants, detergents, corrosion inhibitors, defoamants, extreme pressure additives, seal swell additives, and optionally viscosity modifiers, and the like. Description of typical additives can be found in the book "Lubricant Additives: Chemistry and Applications," L. R. Rudnick, ed. Marcel Dekker Inc., New York, 2001.

Process

One embodiment of the present disclosure discloses a process to produce functionalized mPAOs. This process involves reacting a mPAO having terminal unsaturation with at least one of (i) a substituted or unsubstituted alkyl or aryl thiol (i.e., the alkyl or aryl thiol reacts with the terminal unsaturation of the mPAO) and (ii) a substituted or unsubstituted diphenylamine or naphthalene (i.e., alkylation reaction in which the diphenylamine or naphthalene reacts with the terminal unsaturation of the mPAO).

In an embodiment, this disclosure relates to a process for producing functionalized mPAOs. The process comprises providing a mPAO having a terminal unsaturation in which the mPAO is produced by the metallocene-catalyzed oligomerization or polymerization of an alpha-olefin feed, providing at least one of a substituted or unsubstituted alkyl thiol, aryl thiol, diphenylamine or naphthalene; and reacting, optionally in the presence of a catalyst or initiator, the mPAO having a terminal unsaturation with at least one of the substituted or unsubstituted alkyl thiol, aryl thiol, diphenylamine or naphthalene, under reaction conditions sufficient to produce the functionalized mPAO.

This process of this disclosure produces compositions related to synthesis of specific synthetic fluids with specific physical properties. The specific fluid is a functionalized mPAO fluid that can be used as synthetic base stock or co-base stock for lubes, especially industrial lubes.

With regard to reacting a mPAO having terminal unsaturation with a substituted or unsubstituted alkyl thiol or aryl thiol, the process the process can be carried out over a wide range of temperatures and is carried out at a temperature sufficient to effect reaction. The temperature will preferably be 25° C. to 195° C., more preferably 55° C. to 175° C., and most preferably 95° C. to 165° C. The reaction can be carried out at a single temperature or, sequentially, at different temperatures.

The molar ratio of mPAO having a terminal double bond to substituted or unsubstituted alkyl thiol or aryl thiol is normally in the range of 1.0:1.0 to 10.0:1.0, preferably 1.0:1.0 to 4.0:1.0, more preferably in the range of 1.25:1.0 to 3.0:1.0, and most preferably in the range of 1.5:1.0 to 2.8:1.0. The mole ratio chosen for the reaction will affect the degree of alkyl or aryl thiol conversion to alkylate.

If desired, the reaction can be carried out in a neutral solvent such as mineral oil or an inert hydrocarbon solvent, but usually no solvent is necessary.

Reaction time is a very flexible reaction parameter and is dependent on the reaction temperature, mole ratio of reactants and catalysts, and pressure. The reaction will preferably be carried out over a period of 2 to 30 hours, more preferably over a period of 5 to 24 hours, and most preferably over a period of 6 to 16 hours.

The reaction of a mPAO having terminal unsaturation with a substituted or unsubstituted alkyl or aryl thiol employs an initiator. The initiator can be selected from the group consisting of the following: organic peroxides, such as alkyl peroxides, dialkyl peroxides, aroyl peroxides and peroxy esters, and azo compounds. Preferred alkyl hydroperoxides include tertiary-butyl hydroperoxide, tertiary-octyl hydroperoxide and cumene hydroperoxide; preferred dialkyl peroxides include ditertiary-butyl peroxide, 2,5-dimethyl-2,5-di(t-butylperoxy)hexane and di-cumyl peroxide; preferred aroyl peroxides include benzoyl peroxide; preferred peroxy esters include tertiary-butyl peroxypivalate, t-butylperoxy-2-ethylhexanoate (Trigonox 21®) and tertiary-butyl-perbenzoate; and preferred azo compounds include azo-bis-isobutyronitrile. Free radical initiators with an appropriate half-life at reaction temperatures ranging from 50° C. to 300° C. can be used. Of these, t-butyl peroxypivalate, t-butylperoxy-2-ethylhexanoate (Trigonox 21®) and t-butyl peroxide are most preferred. The initiator can be used in conventional amounts.

Illustrative alkyl thiol and aryl thiol compounds useful in the process of this disclosure include substituted and non-substituted species.

Illustrative substituted or unsubstituted alkyl thiol compounds include, for example, methanethiol (m-mercaptan), ethanethiol (e-mercaptan), 1-propanethiol (n-P mercaptan), 2-propanethiol (2C3 mercaptan), 1-butanethiol (n-butyl mercaptan), tert-butyl mercaptan, 1-pentane thiols (pentyl mercaptan), 1-hexane thiols (hexyl mercaptan), 1-heptane thiols (heptyl mercaptan), 1-octane thiols (octyl mercaptan), 1-nonane thiols (nonyl mercaptan), 1-decane thiols (decyl mercaptan), and the like.

The substituted or unsubstituted alkyl thiols can be linear or branched, even or odd alkyl carbon chain length of $C_6$-$C_{20}$ carbons. Other illustrative substituted or unsubstituted alkyl thiols include 1-dodecanethiol, 1-hexadecanethiol, 1-octadecanethiol, cyclohexanethiol, 2,4,4-trimethyl-2-pentanethiol, etc. or combination of those. Functional thio-alkanes can be used to react with mPAO dimer. Examples of functional thio-alkane include, for example, mercaptoethyoxy ethanol ($HO—CH_2—CH_2—O—CH_2—CH_2—SH$), Ethanethio, 2-ethoxy-($CH_3—CH_2—O—CH_2—CH_2—SH$), 1-Mercapto-4,7,10-trioxaundecane ($HS—CH_2—CH_2—O—CH_2—CH_2—O—CH_2—CH_2—O—CH_3$).

Illustrative substituted or unsubstituted aryl thiol compounds include, for example, thiophenol, 2,3,4,5,6-pentafluorothiophenol, 2,3,5,6-tetrafluorophenol, 2,3-dichlorothiophenol, 2,4-dichlorothiophenol, 2,5-dichlorothiophenol, 3,4-dichlorothiophenol, 3,5-dichlorothiophenol, 2,4-difluorothiophenol, 3,4-difluorothiophenol, 2-bromothiophenol, 3-bromothiophenol, 4-bromothiophenol, 2-chlorothiophenol, 3-chlorothiophenol, 4-chlorothiophenol, 2-fluorothiophenol, 3-fluorothiophenol, 4-fluorothiophenol, 2-chlorobenzenemethanethiol, 4-chlorobenzenemethanethiol, (3-nitrobenzyl)mercaptan, (4-nitrobenzyl)mercaptan, 2-mercaptobenzyl alcohol, 4-nitrothiophenol, 2-mercaptophenol, 3-mercaptophenol, 4-mercaptophenol, 2-aminothiophenol, 3-aminothiophenol, 4-aminothiophenol, 2-(trifluoromethyl)benzenethiol, 4-bromo-2-fluorobenzyl mercaptan, 4-chloro-2-fluorobenzyl mercaptan, 3,4-difluorobenzyl mercaptan, 3,5-difluorobenzyl mercaptan, 3-mercaptobenzoic acid, 4-mercaptobenzoic acid, thiosalicylic acid, 2-bromobenzyl mercaptan, 3-bromobenzyl mercaptan, 4-bromobenzyl mercaptan, 3-fluorobenzyl mercaptan, 4-fluorobenzyl mercaptan, benzene-1,2-dithiol, benzene-1,3-dithiol, 2-methoxythiophenol, 3-methoxythiophenol, 4-methoxythiophenol, 2-methylbenzenethiol, 3-methylbenzenethiol, benzylmercaptan, 4-(methylsulfanyl)thiophenol, toluene-3,4-dithiol, 2-phenoxyethanethiol, 3-ethoxythiolphenol, 4-methoxy-α-toluenethiol, 2,5-dimethoxythiophenol, 3,4-dimethoxythiophenol, 2,4-dimethylthiophenol, 2,5-dimethylthiophenol, 2,6-dimethylthiophenol, 1,3,5-dimethylthiophenol, 2,6-dimethylthiophenol, 2-ethylbenzenethiol, 2-phenylethanethiol, 1,2-benzenedimethanethiol, 1,3-benzenedimethanethiol, 1,4-benzenedimethanethiol, 2-isopropylbenzenethiol, 4-isopropylbenzenethiol, 4-(dimethylamino)thiophenol, 1-naphthalenethiol, 2-naphthalenethiol, 2,4,6-trimethylbenzyl mercaptan, 4-tert-butylbenzyl mercaptan, 4-tert-butylbenzenethiol, biphenyl-4,4'-dithiol, tert-dodecylmercaptan, triphenylmethanethiol, and the like.

With regard to reacting a mPAO having terminal unsaturation with substituted or unsubstituted diphenylamine or naphthalene, the process can be carried out over a wide range of temperatures and is carried out at a temperature sufficient to effect reaction. The temperature will preferably be 25° C. to 195° C., more preferably 55° C. to 175° C., and most preferably 95° C. to 165° C. The reaction can be carried out at a single temperature or, sequentially, at different temperatures.

The reaction can likewise be carried out over a wide range of pressures and is carried out at a pressure sufficient to effect reaction. The reaction pressure will preferably be 250 psi (1.72 MPa) or less and more preferably be 25 to 100 psi (0.17 to 0.69 MPa).

The molar ratio of mPAO having a terminal double bond to substituted or unsubstituted diphenylamine or naphthalene is normally in the range of 1.0:1.0 to 10.0:1.0, preferably 1.0:1.0 to 4.0:1.0, more preferably in the range of 1.25:1.0 to 3.0:1.0, and most preferably in the range of 1.5:1.0 to 2.8:1.0. The mole ratio chosen for the reaction will affect the degree of diphenylamine or naphthalene conversion to alkylate.

If desired, the reaction can be carried out in a neutral solvent such as mineral oil or an inert hydrocarbon solvent, but usually no solvent is necessary.

Reaction time is a very flexible reaction parameter and is dependent on the reaction temperature, mole ratio of reactants and catalysts, and pressure. The reaction will preferably be carried out over a period of 2 to 30 hours, more preferably over a period of 5 to 24 hours, and most preferably over a period of 6 to 16 hours.

The reaction of a mPAO having terminal unsaturation with substituted or unsubstituted diphenylamine or naphthalene employs a catalyst. The catalyst can be selected from the group consisting of the following: one or more Friedel-Crafts catalysts; protonic acid (Bronsted acid) catalysts, such as sulfuric acid, hydrochloric acid, and phosphoric acid; Amberlyst 15 (styrene-divinylbenzene polymer of Rohm & Haas, Co.); strongly acidic ion-exchange resins, such as Dowex 50W (The Dow Chemical Company); solid acid catalysts, such as zeolites (such as MCM22 and ZMS-48), acid clays, and amorphous solid acid catalysts (such as $WO_x/ZrO_2$ and silica-aluminate); ionic liquid catalysts; and any combination of the foregoing.

Useful clay catalysts include commercially available clay catalysts, including the following: Filtrol™ and Retrol™ available from Engelhard; Fulcat™ 14, Fulmont™ 700C, Fulmont™ 237, and Fulcat™ 22B available from Laporte Industries; and Katalysator™ K10 available from Sud-Chemi. These clays may include acid-activated or acid-leached clays. The clay catalysts may contain some water as received or water may be removed prior to use by heating with a nitrogen sweep or with vacuum stripping. Acid-activated clays are preferred. However, Lewis Acids such as $AlCl_3$ or $BF_3$, and $BF_3$ complexes of diethyl ether, phenol, including mixtures thereof with clay could be used as well. A preferred catalyst is Engelhard F-24 acid-activated clay (formerly Filtrol's Retrol clays).

Preferred catalysts are Engelhard clay F-24 catalyst and acidic ionic liquids. Useful acidic ionic liquids have at least two components. The first component is an acidic compound. The second component is an ionic liquid. Useful catalysts are disclosed, for example, in U.S. Patent Application Publication No. 2009/0221760, which is incorporated herein by reference.

Illustrative diphenylamine and naphthalene compounds useful in the process of this disclosure include substituted and non-substituted species.

Illustrative substituted or unsubstituted diphenylamine species may be represented by the following formula:

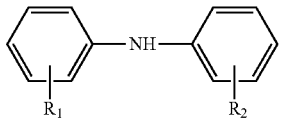

wherein $R_1$ and $R_2$ are, independently, a hydrogen or an alkyl group of 1 to 12 carbons or an aryl group of 1 to 12 carbons. A preferred species is unsubstituted, wherein both $R_1$ and $R_2$ are hydrogen. Useful substituted diphenylamines include N-phenyl-1-naphthylamine, N-phenyl-2-naphthylamine, N,N'-diphenyl-p-phenylenediamine, and the like.

Other aromatic species include, for example, naphthalene, benzene, furan, thiophene, anthracene, phenanthrene, pyrrole, indole, benzothiophene, dibenzothiophene, benzofuran, dibenzofuran, phenoxathiin, thianthrene, biphenyl, pyrene, and mixtures thereof, each of which can be optionally substituted. Further preferred aromatic compound may be toluene, o-, or p-xylene, hydroxylbenzene, alkoxybenzene such as methoxy or ethoxybenzene, thioanisole, diphenylether, diphenylmethane, bisphenol-A, bisphenol sulfide, diphenyl sulfide, naphthalene, methylnaphthalene, methoxynaphthalene, ethoxynaphthalene, methylnaphthal sulfide, ethyl naphthylsulfide, or mixtures thereof and the like.

mPAOs Having Terminal Unsaturation

Illustrative mPAOs having terminal unsaturation useful in the process of this disclosure include a co-polymer made from at least two alpha-olefins or more, or a homo-polymer made from a single alpha-olefin feed by a metallocene catalyst system.

This copolymer mPAO composition is made from at least two alpha-olefins of $C_3$ to $C_{30}$ range and having monomers randomly distributed in the polymers. It is preferred that the average carbon number is at least 4.1. Advantageously, ethylene and propylene, if present in the feed, are present in the amount of less than 50 wt % individually or preferably less than 50 wt % combined. The copolymers useful in the process of the disclosure can be isotactic, atactic, syndiotactic polymers or any other form of appropriate tacticity. These copolymers have useful lubricant properties including excellent viscosity index (VI), pour point, low temperature viscometrics by themselves or as blend fluid with other lubricants or other polymers. Furthermore, these copolymers have narrow molecular weight distributions and excellent lubricating properties.

In an embodiment, the mPAO having a terminal double bond is made from the mixed feed LAOs comprising at least two and up to 26 different linear alpha-olefins selected from $C_3$ to $C_{30}$ linear alpha-olefins. In a preferred embodiment, the mixed feed LAO is obtained from an ethylene growth process using an aluminum catalyst or a metallocene catalyst. The growth olefins comprise mostly $C_6$ to $C_{18}$-LAO. LAOs from other process, such as the SHOP process, can also be used.

This homo-polymer mPAO composition is made from single alpha-olefin choosing from $C_3$ to $C_{30}$ range, preferably $C_3$ to $C_{16}$, most preferably $C_3$ to $C_{14}$ or $C_3$ to $C_{12}$. The homo-polymers of the disclosure can be isotactic, atactic, syndiotactic polymers or any combination of these tacticity or other form of appropriate tacticity. Often the tacticity can be carefully tailored by the polymerization catalyst and polymerization reaction condition chosen or by the functionalization of the alpha-olefin described herein. These homo-polymers have useful lubricant properties including excellent VI, pour point, low temperature viscometrics by themselves or as blend fluid with other lubricants or other polymers. Furthermore, these homo-polymers have narrow molecular weight distributions and excellent lubricating properties.

In another embodiment, the alpha-olefin(s) can be chosen from any component from a conventional LAO production facility or from refinery. It can be used alone to make homo-polymer or together with another LAO available from refinery or chemical plant, including propylene, 1-butene, 1-pentene, and the like, or with 1-hexene or 1-octene made from dedicated production facility. In another embodiment, the alpha-olefins can be chosen from the alpha-olefins produced from Fischer-Tropsch synthesis (as reported in U.S. Pat. No. 5,382,739). For example, $C_3$ to $C_{16}$-alpha-olefins, more preferably linear alpha-olefins, are suitable to make homo-polymers. Other combinations, such as $C_4$ and $C_{14}$-LAO; $C_6$ and $C_{16}$-LAO; $C_8$, $C_{10}$, $C_{12}$-LAO; or $C_8$ and $C_{14}$-LAO; $C_6$, $C_{10}$, $C_{14}$-LAO; $C_4$ and $C_{12}$-LAO, and the like, are suitable to make co-polymers.

The activated metallocene catalyst can be simple metallocenes, substituted metallocenes or bridged metallocene catalysts activated or promoted by, for instance, methylaluminoxane (MAO) or a non-coordinating anion, such as N,N-dimethylanilinium tetrakis(perfluorophenyl)borate or other equivalent non-coordinating anion and optionally with co-activators, typically trialkylaluminum compounds.

According to the disclosure, a feed comprising a mixture of LAOs selected from $C_3$ to $C_{30}$-LAOs or a single LAO selected from $C_3$ to $C_{16}$-LAO, is contacted with an activated metallocene catalyst under oligomerization conditions to provide a liquid product suitable for use in the process of the disclosure. A copolymer composition made from at least two alpha-olefins of $C_3$ to $C_{30}$ range and having monomers randomly distributed in the polymers is useful in the process of this disclosure. The phrase "at least two alpha-olefins" will be understood to mean "at least two different alphaolefins" (and similarly "at least three alpha-olefins" means "at least three different alpha-olefins", and so forth).

In preferred embodiments, the average carbon number (defined hereinbelow) of said at least two alpha-olefins in said feed is at least 4.1. In another preferred embodiment, the amount of ethylene and propylene in said feed is less than 50 wt % individually or preferably less than 50 wt % combined. A still more preferred embodiment comprises a feed having both of the aforementioned preferred embodiments, i.e., a feed having an average carbon number of at least 4.1 and wherein the amount of ethylene and propylene is less than 50 wt % individually.

In embodiments, the mPAO obtained is an essentially random liquid copolymer comprising the at least two alpha-olefins. By "essentially random" is meant that one of ordinary skill in the art would consider the products to be random copolymer. Other characterizations of randomness, some of which are preferred or more preferred, are provided herein. Likewise the term "liquid" will be understood by one of ordinary skill in the art, but more preferred characterizations of the term are provided herein. In describing the products as "comprising" a certain number of alpha-olefins (at least two different alpha-olefins), one of ordinary skill in the art in possession of the present disclosure would understand that what is being described in the polymerization (or oligomerization) product incorporating said certain number of alpha-olefin monomers. In other words, it is the product obtained by polymerizing or oligomerizing said certain number of alpha-olefin monomers.

This process employs a catalyst system comprising a metallocene compound (Formula 1, below) together with an activator such as a non-coordinating anion (NCA) (Formula 2, below) and optionally a co-activator such as a trialkylaluminum, or with methylaluminoxane (MAO) (Formula 3, below).

Formula 1

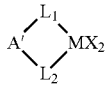

Formula 2

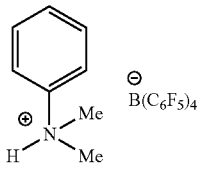

NCA

Formula 3

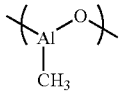

MAO

The term "catalyst system" is defined herein to mean a catalyst precursor/activator pair, such as a metallocene/activator pair. When "catalyst system" is used to describe such a pair before activation, it means the unactivated catalyst (precatalyst) together with an activator and, optionally, a co-activator (such as a trialkyl aluminum compound). When it is used to describe such a pair after activation, it means the activated catalyst and the activator or other charge-balancing moiety. Furthermore, this activated "catalyst system" may optionally comprise the co-activator and/or other charge-balancing moiety. Optionally and often, the co-activator, such as trialkylaluminum compound, is also used as impurity scavenger.

The metallocene is selected from one or more compounds according to Formula 1, above. In Formula 1, M is selected from Group 4 transition metals, preferably zirconium (Zr), hafnium (Hf) and titanium (Ti), L1 and L2 are independently selected from cyclopentadienyl ("Cp"), indenyl, and fluorenyl, which may be substituted or unsubstituted, and which may be partially hydrogenated, A can be no atom, as in many un-bridged metallocenes or A is an optional bridging group which if present, in preferred embodiments is selected from dialkylsilyl, dialkylmethyl, diphenylsilyl or diphenylmethyl, ethylenyl (—$CH_2$—$CH_2$—), alkylethylenyl (—$CR_2$—$CR_2$—), where alkyl can be independently $C_1$ to $C_{16}$ alkyl radical or phenyl, tolyl, xylyl radical and the like, and wherein each of the two X groups, Xa and Xb, are independently selected from halides, OR (R is an alkyl group, preferably selected from $C_1$ to $C_5$ straight or branched chain alkyl groups), hydrogen, $C_1$ to $C_{16}$ alkyl or aryl groups, haloalkyl, and the like. Usually relatively more highly substituted metallocenes give higher catalyst productivity and wider product viscosity ranges and are thus often more preferred.

In another embodiment, any of the PAOs described herein may have monomer units represented by the formula, in addition to the all regular 1,2-connection.

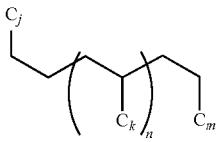

where j, k and m are each, independently, 1, 2, 3, 4, 5, 6, 7, 8, 9, 10, 11, 12, 13, 14, 15, 16, 17, 18, 19, 20, 21, or 22, n is an integer from 1 to 350 (preferably 1 to 300, preferably 5 to 50) as measured by proton NMR.

Illustrative mPAOs having terminal unsaturation useful in the process of this disclosure include a co-polymer made from at least two alpha-olefins or more, or a homo-polymer made from a single alpha-olefin feed by a metallocene catalyst system.

In another embodiment, any of the PAOs described herein preferably have a molecular weight distribution (MWD=Mw/Mn) of greater than 1 and less than 5, preferably less than 4, preferably less than 3, preferably less than 2.5.

In another embodiment, any PAO described herein may have a kinematic viscosity at 100° C. from 135 to 1000 cSt, preferably from 150 to 900 cSt, preferably from 300 to 800 cSt as measured by ASTM D445.

In another embodiment, any PAO described herein may have a viscosity index (VI) of 100 or more, preferably 120 or more, preferably 130 or more, alternately, form 120 to 450, alternately from 100 to 400, alternately from 120 to 380, alternately from 100 to 300, alternately from 140 to 380, alternately from 180 to 306, alternately from 252 to 306, alternately the viscosity index is at least 165, alternately at least 187, alternately at least 200, alternately at least 252. Viscosity index is determined according to ASTM Method D 2270-93 (1998).

All kinematic viscosity values reported for fluids herein are measured at 100° C. unless otherwise noted. Dynamic viscosity can then be obtained by multiplying the measured kinematic viscosity by the density of the liquid. The units for kinematic viscosity are in $mm^2/s$, commonly converted to cSt or centistokes (1 cSt=10-6 $m^2/s$ or 1 cSt=1 $mm^2/sec$).

The process to produce these mPAO polymers employs metallocene catalysts together with one or more activators (such as an alumoxane or a non-coordinating anion) and optionally with co-activators such as trialkylaluminum compounds. The metallocene catalyst can be a bridged or unbridged, substituted or unsubstituted cyclopentadienyl, indenyl or fluorenyl compound. One preferred class of catalysts is highly substituted metallocenes that give high catalyst productivity and higher product viscosity. Another preferred class of metallocenes is bridged and substituted cyclopentadienes. Another preferred class of metallocenes is bridged and substituted indenes or fluorenes. One aspect of the processes described herein also includes treatment of the feed olefins to remove catalyst poisons, such as peroxides, oxygen, sulfur, nitrogen-containing organic compounds, and or acetylenic compounds. This treatment is believed to increase catalyst productivity, typically more than 5 fold, preferably more than 10 fold.

A preferred embodiment is a process to produce a mPAO comprising: 1) contacting at least one alpha-olefin monomer having 3 to 30 carbon atoms with a metallocene compound and an activator under polymerization conditions, wherein the alpha-olefin monomer having 3 to 30 carbon atoms is present at 10 volume % or more based upon the total volume of the catalyst/activator/co-activator solutions, monomers, and any diluents or solvents present in the reaction; and 2) obtaining a mPAO comprising at least 50 mole % of a $C_3$ to $C_{30}$ alpha-olefin monomer, wherein the mPAO has a kinematic viscosity at 100° C. of 5000 cSt or less, and the mPAO comprises Z mole % or more of units represented by the formula:

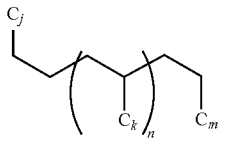

where j, k and m are each, independently, 1, 2, 3, 4, 5, 6, 7, 8, 9, 10, 11, 12, 13, 14, 15, 16, 17, 18, 19, 20, 21, or 22, n is an integer from 1 to 350.

An alternate embodiment is a process to produce a mPAO comprising: contacting a feed stream comprising one or at least one alpha-olefin monomer having 3 to 30 carbon atoms with a metallocene catalyst compound and a non-coordinating anion activator or alkylalumoxane activator, and optionally an alkyl-aluminum compound, under polymerization conditions wherein the alpha-olefin monomer having 3 to 30 carbon atoms is present at 10 volume % or more based upon the total volume of the catalyst/activator/co-activator solution, monomers, and any diluents or solvents present in the reactor and where the feed alpha-olefin, diluent or solvent stream comprises less than 300 ppm of heteroatom containing compounds; and obtaining a mPAO comprising at least 50 mole % of a $C_5$ to $C_{24}$ alpha-olefin monomer where the mPAO has a kinematic viscosity at 100° C. of 5000 cSt or less.

An alternate embodiment is a process to produce a mPAO comprising: 1) contacting a feed stream comprising at least one alpha-olefin monomer having 3 to 30 carbon atoms with a metallocene catalyst compound and a non-coordinating anion activator or alkylalumoxane activator, and optionally an alkyl-aluminum compound, under polymerization conditions wherein the alpha-olefin monomer having 3 to 30 carbon atoms is present at 10 volume % or more based upon the total volume of the catalyst/activator/co-activator solution, monomers, and any diluents or solvents present in the reactor and where the feed alpha-olefin, diluent or solvent stream comprises less than 300 ppm of heteroatom containing compounds which; and obtaining a mPAO comprising at least 50 mole % of a $C_5$ to $C_{24}$ alpha-olefin monomer where the mPAO has a kinematic viscosity at 100° C. of 5000 cSt or less; and 2) isolating the lube fraction polymers and then functionalizing the alpha-olefin under reaction conditions as described herein to give fluid with Bromine Number below 1.8.

Lubricant Formulations

The formulations of this disclosure are based on high viscosity, functionalized synthetic Group IV mPAOs. In an embodiment, to a high Viscosity Index, functionalized metallocene-catalyzed PAO of greater than 135 cSt can be added one or more of Group V base stocks, such as an ester, a polyalkylene glycol or an alkylated aromatic, as a co-base for additive solubility. A detailed description of suitable Group V base stocks can be found in "Synthetics, Mineral Oils and Bio-Based Lubricants, Chemistry and Technology" Edited by L. R. Rudnick, published by CRC Press, Taylor & Francis, 2005. The esters of choice are dibasic esters (such as adipate ester, ditridecyl adipate), mono-basic esters, polyol esters, including pentherythyol (TMP esters), and phthalate esters. The alkylated aromatics of choice are alkylbenzene, alkylated naphthalene and other alkylated aromatics such as alkylated diphenylether, diphenylsulfide, biphenyl, and the like.

In one embodiment, the base stock comprises lubricant oil with a viscosity of over 135 cSt, and more preferably 150 and higher cSt, Kv100° C. Most preferably, the base stock is over 135 cSt, Kv100° C. but less than 5000 cSt. The base stock has a molecular weight distribution greater than 1 and less than 5.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between 80 to 120 and contain greater than 0.03% sulfur and/or less than 900% saturates. Group II base stocks generally have a viscosity index of between 80 to 120, and contain less than or equal to 0.03% sulfur and greater than or equal to 90% saturates. Group III stock generally has a viscosity index greater than 120 and contains less than or equal to 0.03% sulfur and greater than 90% saturates. Group IV includes polyalphaolefins (PAO). Group V base stocks include base stocks not included in Groups I-IV. Table 1 summarizes properties of each of these five groups. All discussion of Group I to V base stocks can be found in "Synthetics, Mineral Oils and Bio-Based Lubricants, Chemistry and Technology" Edited by L. R. Rudnick, published by CRC Press, Taylor & Francis, 2005.

Group VI in Table 1 are polyinternal olefins ("PIO"). Polyinternal olefins are long-chain hydrocarbons, typically a linear backbone with some branching randomly attached; they are obtained by oligomerization of internal n-olefins. The catalyst is usually a BF3 complex with a proton source that leads to a cationic polymerization, or promoted BF3 or AlCl3 catalyst system. The process to produce polyinternal olefins (PIO) consists of four steps: reaction, neutralization/washing, hydrogenation and distillation. These steps are somewhat similar to PAO process. PIO are typically available in low viscosity grades, 4 cSt, 6 cSt and 8 cSt. If necessary, low viscosity, 1.5 to 3.9 cSt can also be made conveniently by the BF3 process or other cationic processes. Typically, the n-olefins used as starting material are n-$C_{12}$-$C_{18}$ internal olefins, more preferably, n-$C_{14}$-$C_{16}$ olefins are used. PIO can be made with VI and pour points very similar to PAO, only slightly inferior. They can be used in engine and industrial lubricant formulations. For more detailed discussion, see Chapter 2, Polyinternalolefins in the book, "Synthetics, Mineral Oils, and Bio-Based Lubricants—Chemistry and Technology" Edited by Leslie R. Rudnick, p. 37-46, published by CRC Press, Taylor & Francis Group, 2006; or "Polyinternal Olefins" by Corsico, G.; Mattei, L.; Roselli, A.; Gommellini, C. EURON, Milan, Italy. Chemical Industries (Dekker) (1999), 77 (Synthetic Lubricants and High-Performance Functional Fluids, (2nd Edition)), 53-62. Publisher: Marcel Dekker, Inc. PIO was classified by itself as Group VI fluid in API base stock classification.

TABLE 1

| | Base Stock Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) | | |
| Group V | All other base oil stocks not included in Groups I, II, III or IV | | |
| Group VI | Polyinternal olefins (PIO) | | |

In a preferred embodiment, the base stocks include at least one base stock of synthetic oils and most preferably include at least one base stock of API Group IV poly alpha olefins. Synthetic oil for purposes of this application shall include all oils that are not naturally occurring mineral oils. Naturally occurring mineral oils are often referred to as API Group I oils.

The lube fluids made directly from the polymerization or oligomerization process, and functionalization as described herein, have improved oxidative stability. The functionalized lube fluids have reduced unsaturated double bonds or reduced olefinic molecular structure, and do not require hydrogenation. The amount of double bonds or unsaturation or olefinic components can be measured by several methods, such as Bromine Number (ASTM 1159), bromine index (ASTM D2710) or other suitable analytical methods, such as NMR, IR, and the like. The amount of the double bond or the amount of olefinic compositions depends on several factors—the degree of polymerization and the amount of promoters which participate in the termination steps of the polymerization process, or other agents present in the process. In accordance with this disclosure, the amount of double bonds or the amount of olefinic components is decreased by reacting the lube fluid having a terminal bond with at least one of the alkyl or aryl thiol, diphenylamine or naphthalene as described herein.

The oxidative stability of fluids is improved when the amount of unsaturation double bonds or olefinic contents is reduced by reacting the lube fluid having a terminal bond with at least one of the alkyl or aryl thiol, diphenylamine or naphthalene. In an embodiment, the functionalized polymer may optionally be hydrotreated if they have high degree of unsaturation. Usually, the fluids with Bromine Number of less than 5, as measured by ASTM D1159, is suitable for high quality base stock application. Of course, the lower the Bromine Number, the better the lube quality. Fluids with Bromine Number of less than 3 or 2 are common. The most preferred range is less than 1 or less than 0.1. The method to hydrotreat to reduce the degree of unsaturation is well known in literature (U.S. Pat. No. 4,827,073).

Another type of PAO, classified as Group IV base stock and used extensively in many synthetic or partial synthetic industrial lubricants, is produced by oligomerization or polymerization of linear alpha-olefins of $C_6$ to $C_{16}$ by promoted BF3 or AlCl3 catalysts. This type of PAO is available in many viscosity grades ranging from 1.7 cSt to 100 cSt from ExxonMobil Chemical Co.

Base stocks having a high paraffinic/naphthenic and saturation nature of greater than 90 weight percent can often be used advantageously in certain embodiments. Such base stocks include Group II and/or Group III hydroprocessed or hydrocracked base stocks, or their synthetic counterparts such as PAO oils, GTL or similar base oils or mixtures of similar base oils. For purposes of this application synthetic bases stocks shall include Group II, Group III, Group IV and Group V base stocks.

The Group V base stocks can be used as an additional base stock or as a co-base stock with the base stocks for additive solubility. The preferred ester is an alkyl adipate, TMP ester, a polyol ester or aromatic ester, such as phthalate ester. The preferred alkyl aromatics are alkylbenzenes or alkylnaphthalenes. The preferred polyalkylene glycols are liquid polymers or copolymers made from ethylene oxide, propylene oxide, butylenes oxides or higher alkylene oxides with some degree of compatibility with PAO, other hydrocarbon fluids, GTL or mineral oils.

Gas to liquid (GTL) base stocks can also be preferentially used with the components of this disclosure as a portion or all of the base stocks used to formulate the finished lubricant. Favorable improvement can be achieved when the components of this disclosure are added to lubricating systems comprising primarily Group II, Group III and/or GTL base stocks compared to lesser quantities of alternate fluids.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) include oils boiling in the lube oil boiling range separated/fractionated from GTL materials such as by, for example, distillation or thermal diffusion, and subsequently subjected to well-known catalytic or solvent dewaxing processes to produce lube oils of reduced/low pour point; wax isomerates, comprising, for example, hydroisomerized or isodewaxed synthesized hydrocarbons; hydro-isomerized or isodewaxed Fischer-Tropsch ("F-T") material (i.e., hydrocarbons, waxy hydrocarbons, waxes and possible analogous oxygenates); preferably hydroisomerized or isodewaxed F-T hydrocarbons or hydroisomerized or isodewaxed F-T waxes, hydroisomerized or isodewaxed synthesized waxes, or mixtures thereof.

GTL base stock(s) derived from GTL materials, especially, hydroisomerized/isodewaxed F-T material derived base stock(s), and other hydroisomerized/isodewaxed wax derived base stock(s) are characterized typically as having kinematic viscosities at 100° C. of from 2 $mm^2/s$ to 50 $mm^2/s$, preferably from 3 $mm^2/s$ to 50 $mm^2/is$, more preferably from 3.5 $mm^2/s$ to 30 $mm^2/s$, as exemplified by a GTL base stock derived by the isodewaxing of F-T wax, which has a kinematic viscosity of 4 $mm^2/s$ at 100° C. and a viscosity index of 130 or greater. The term GTL base oil/base stock and/or wax isomerate base oil/base stock as used herein and in the claims is to be understood as embracing individual fractions of GTL base stock/base oil or wax isomerate base stock/base oil as recovered in the production process, mixtures of two or more GTL base stocks/base oil fractions and/or wax isomerate base stocks/base oil fractions, as well as mixtures of one or two or more low viscosity GTL base stock(s)/base oil fraction(s) and/or wax isomerate base stock(s)/base oil fraction(s) with one, two or more high viscosity GTL base stock(s)/base oil fraction(s) and/or wax isomerate base stock(s)/base oil fraction(s) to produce a bi-modal blend wherein the blend exhibits a viscosity within the aforesaid recited range. Reference herein to Kinematic Viscosity refers to a measurement made by ASTM method D445.

GTL base stocks and base oils derived from GTL materials, especially hydroisomerized/isodewaxed F-T material derived base stock(s), and other hydroisomerized/isodewaxed wax-derived base stock(s), such as wax hydroisomerates/isodewaxates, which can be used as base stock components of this disclosure are further characterized typically as having pour points of −5° C. or lower, preferably −10° C. or lower, more preferably −15° C. or lower, still more preferably −20° C. or lower, and under some conditions may have advantageous pour points of −25° C. or lower, with useful pour points of −30° C. to −40° C. or lower. If necessary, a separate dewaxing step may be practiced to achieve the desired pour point. References herein to pour point refer to measurement made by ASTM D97 and similar automated versions.

The GTL base stock(s) derived from GTL materials, especially hydroisomerized/isodewaxed F-T material derived base stock(s), and other hydroisomerized/isodewaxed wax-derived base stock(s) which are base stock components which can be used in this disclosure are also characterized typically as having viscosity indices of 80 or greater, preferably 100 or greater, and more preferably 120 or greater. Additionally, in certain particular instances, viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

In addition, the GTL base stock(s) are typically highly paraffinic of greater than 90 percent saturates) and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than 10 ppm, and more typically less than 5 ppm of each of these elements. The sulfur and nitrogen content of GTL base stock and base oil obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s), hydroisomerized or isodewaxed F-T material derived base stock(s), and wax-derived hydroisomerized/isodewaxed base stock(s), such as wax isomerates/isodewaxates, are recited in U.S. Pat. Nos. 6,080,301; 6,090,989, and 6,165,949, for example.

Additives

The high viscosity, functionalized mPAO base stocks useful in this disclosure can impart even further favorable properties when combined with specific additive systems. The additives include various commercially available gear oil packages. These additive packages include a high performance series of components that include antiwear, antioxidant, defoamant, demulsifier, detergent, dispersant, metal passivation, and rust inhibition additive chemistries to deliver desired performance.

The additives may be chosen to modify various properties of the lubricating oils. For gear oils, the additives should provide the following properties, antiwear protection, rust protection, micropitting protection, friction reduction, and improved filterability. Persons skilled in the art will recognize various additives that can be chosen to achieve favorable properties including favorable properties for gear oil applications.

The final lubricant should comprise a lubricant base stock having a viscosity of greater than 135 cSt, Kv 100° C. The lubricant base stock should comprise of at least 10 percent and no more than 70 percent of the final lubricant. Preferred range is at least 20 percent to 60 percent. The amount of Group V base stocks, such as esters, polyalkylene glycols or alkylated aromatics and/or additive can be up to 90 percent of the final lubricant total with a proportional decrease in the acceptable ranges of base stocks. The preferred range of Group V, such as esters and additives is between 10 and 90 percent. Sometimes, some Group I or II base stock can be used in the formulation together with ester or alkylated aromatics or as a total substitute.

In various embodiments, it will be understood that additives well known as functional fluid additives in the art, can also be incorporated in the functional fluid composition of the disclosure, in relatively small amounts, if desired; frequently, less than 0.001% up to 10-20% or more. In one embodiment, at least one oil additive is added from the group consisting of antioxidants, stabilizers, antiwear additives, dispersants, detergents, antifoam additives, viscosity index improvers, copper passivators, metal deactivators, rust inhibitors, corrosion inhibitors, pour point depressants, demulsifiers, anti-wear agents, extreme pressure additives and friction modifiers. The additives listed below are non-limiting examples and are not intended to limit the claims.

Dispersants should contain the alkenyl or alkyl group R has a Mn value of 500 to 5000 and an Mw/Mn ratio of 1 to 5. The preferred Mn intervals depend on the chemical nature of the agent improving filterability. Polyolefinic polymers suitable for the reaction with maleic anhydride or other acid materials or acid forming materials, include polymers containing a predominant quantity of $C_2$ to $C_5$ monoolefins, for example, ethylene, propylene, butylene, isobutylene and pentene. A highly suitable polyolefinic polymer is poly-isobutene. The succinic anhydride preferred as a reaction substance is PIBSA, that is, polyisobutenyl succinic anhydride.

If the dispersant contains a succinimide comprising the reaction product of a succinic anhydride with a polyamine, the alkenyl or alkyl substituent of the succinic anhydride serving as the reaction substance consists preferably of polymerized isobutene having an Mn value of 1200 to 2500. More advantageously, the alkenyl or alkyl substituent of the succinic anhydride serving as the reaction substance consists in a polymerized isobutene having an Mn value of 2100 to 2400. If the agent improving filterability contains an ester of succinic acid comprising the reaction product of a succinic anhydride and an aliphatic polyhydric alcohol, the alkenyl or alkyl substituent of the succinic anhydride serving as the reaction substance consists advantageously of a polymerized isobutene having an Mn value of 500 to 1500. In preference, a polymerized isobutene having an Mn value of 850 to 1200 is used.

Amides suitable uses of amines include antiwear agents, extreme pressure additives, friction modifiers or dispersants. The amides which are utilized in the compositions of the present disclosure may be amides of mono- or polycarboxylic acids or reactive derivatives thereof. The amides may be characterized by a hydrocarbyl group containing from 6 to 90 carbon atoms; each is independently hydrogen or a hydrocarbyl, aminohydrocarbyl, hydroxyhydrocarbyl or a heterocyclic-substituted hydrocarbyl group, provided that both are not hydrogen; each is, independently, a hydrocarbylene group containing up to 10 carbon atoms; Alk is an alkylene group containing up to 10 carbon atoms.

The amide can be derived from a monocarboxylic acid, a hydrocarbyl group containing from 6 to 30 or 38 carbon atoms and more often will be a hydrocarbyl group derived from a fatty acid containing from 12 to 24 carbon atoms.

The amide is derived from a di- or tricarboxylic acid, will contain from 6 to 90 or more carbon atoms depending on the type of polycarboxylic acid. For example, when the amide is derived from a dimer acid, will contain from 18 to 44 carbon atoms or more, and amides derived from trimer acids generally will contain an average of from 44 to 90 carbon atoms. Each is independently hydrogen or a hydrocarbyl, aminohydrocarbyl, hydroxyhydrocarbyl or a heterocyclic-substituted hydrocarbon group containing up to 10 carbon atoms. It may be independently heterocyclic substituted hydrocarbyl groups wherein the heterocyclic substituent is derived from pyrrole, pyrroline, pyrrolidine, morpholine, piperazine, piperidine, pyridine, pipecoline, and the like. Specific examples include methyl, ethyl, n-propyl, n-butyl, n-hexyl, hydroxymethyl, hydroxyethyl, hydroxypropyl, amino-methyl, aminoethyl, aminopropyl, 2-ethylpyridine, 1-ethylpyrrolidine, 1-ethylpiperidine, and the like.

The alkyl group can be an alkylene group containing from 1 to 10 carbon atoms. Examples of such alkylene groups include, methylene, ethylene, propylene, and the like. Also are hydrocarbylene groups, and in particular, alkylene group containing up to 10 carbon atoms. Examples of such hydrocarbylene groups include, methylene, ethylene, propylene, and the like. The amide contains at least one morpholinyl group. In one embodiment, the morpholine structure is formed as a result of the condensation of two hydroxy groups which are attached to the hydrocarbylene groups. Typically, the amides are prepared by reacting a carboxylic acid or reactive derivative thereof with an amine which contains at least one >NH group.

Aliphatic monoamines include mono-aliphatic and di-aliphatic-substituted amines wherein the aliphatic groups may be saturated or unsaturated straight chain or branched chain. Such amines include, for example, mono- and di-alkyl-substituted amines, mono- and dialkenyl-substituted amines, and the like. Specific examples of such monoamines include ethyl amine, diethyl amine, n-butyl amine, di-n-butyl amine, isobutyl amine, coco amine, stearyl amine, oleyl amine, and the like. An example of a cycloaliphatic-substituted aliphatic amine is 2-(cyclohexyl)-ethyl amine. Examples of heterocyclic-substituted aliphatic amines include 2-(2-aminoethyl)-pyrrole, 2-(2-aminoethyl)-1-methylpyrrole, 2-(2-aminoethyl)-1-methylpyrrolidine and 4-(2-aminoethyl)morpholine, 1-(2-aminoethyl)piperazine, 1-(2-aminoethyl)piperidine, 2-(2-aminoethyl)pyridine, 1-(2-aminoethyl)pyrrolidine, 1-(3-aminopropyl)imidazole, 3-(2-aminopropyl)indole, 4-(3-aminopropyl)morpholine, 1-(3-aminopropyl)-2-pipecoline, 1-(3-aminopropyl)-2-pyrrolidinone, and the like.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexyl-amines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di-(para-methylphenyl) amine, naphthylamine, N-(n-butyl)-aniline, and the like. Examples of aliphatic-substituted, cycloaliphatic-substituted, and heterocyclic-substituted aromatic monoamines are para-ethoxy-aniline, para-dodecylaniline, cyclohexyl-substituted naphthylamine, variously substituted phenathiazines, and thienyl-substituted aniline.

Polyamines are aliphatic, cycloaliphatic and aromatic polyamines analogous to the above-described monoamines except for the presence within their structure of additional amino nitrogens. The additional amino nitrogens can be primary, secondary or tertiary amino nitrogens. Examples of such polyamines include N-amino-propyl-cyclohexylamines, N,N'-di-n-butyl-paraphenylene diamine, bis-(para-aminophenyl)methane, 1,4-diaminocyclohexane, and the like.

The hydroxyl-substituted amines contemplated are those having hydroxy substituents bonded directly to a carbon atom other than a carbonyl carbon atom; that is, they have hydroxy groups capable of functioning as alcohols. Examples of such hydroxy-substituted amines include ethanolamine, di-(3-hydroxypropyl)-amine, 3-hydroxybutyl-amine, 4-hydroxybutyl-amine, diethanolamine, di-(2-hydroxyamine, N-(hydroxypropyl)-propylamine, N-(2-methyl)-cyclohexylamine, 3-hydroxycyclopentyl parahydroxyaniline, N-hydroxyethal piperazine and the like.

In one embodiment, the amines useful in the present disclosure are alkylene polyamines including hydrogen, or a hydrocarbyl, amino hydrocarbyl, hydroxyhydrocarbyl or heterocyclic-substituted hydrocarbyl group containing up to 10 carbon atoms. Alk is an alkylene group containing up to 10 carbon atoms, and is 2 to 10. Preferably, Alk is ethylene or propylene. Usually, a will have an average value of from 2 to 7. Examples of such alkylene polyamines include methylene polyamines, ethylene polyamines, butylene polyamines, propylene polyamines, pentylene polyamines, hexylene polyamines, heptylene polyamines, and the like.

Alkylene polyamines include ethylene diamine, triethylene tetramine, propylene diamine, trimethylene diamine, hexamethylene diamine, decamethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology. Second Edition, Kirk and Othmer, Volume 7, pages 27-39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, and the like. These reactions result in the production of the somewhat complex mixtures of alkylene polyamines, including cyclic condensation products such as piperazines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than 2, usually less than 1% (by weight) material boiling below 200° C. In the instance of ethylene polyamine bottoms, which are readily available and found to be quite useful, the bottoms contain less than 2% (by weight) total diethylene triamine (DETA) or triethylene tetramine (TETA). A typical sample of such ethylene polyamine bottoms obtained from the Dow Chemical Company of Freeport, Tex. designated "E-100". Gas chromatography analysis of such a sample showed it to contain 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

The dispersants are selected from: Mannich bases that are condensation reaction products of a high molecular weight phenol, an alkylene polyamine and an aldehyde such as formaldehyde; succinic-based dispersants that are reaction products of a olefin polymer and succinic acylating agent (acid, anhydride, ester or halide) further reacted with an organic hydroxy compound and/or an amine; high molecular weight amides and esters such as reaction products of a hydrocarbyl acylating agent and a polyhydric aliphatic alcohol (such as glycerol, pentaerythritol or sorbitol). Ashless (metal-free) polymeric materials that usually contain an oil soluble high molecular weight backbone linked to a polar functional group that associates with particles to be dispersed are typically used as dispersants. Zinc acetate capped, also any treated dispersant, which include borated, cyclic carbonate, end-capped, polyalkylene maleic anhydride and the like; mixtures of some of the above, in treat rates that range from 0.1% up to 10-20% or more. Commonly used hydrocarbon backbone materials are olefin polymers and copolymers, i.e., -ethylene, propylene, butylene, isobutylene, styrene; there may not be further functional groups incorporated into the backbone of the polymer, whose molecular weight ranges from 300 tp to 5000. Polar materials such as amines, alcohols, amides or esters are attached to the backbone via a bridge.

Antioxidants include sterically hindered alkyl phenols such as 2,6-di-tert-butylphenol, 2,6-di-tert-butyl-p-cresol and 2,6-di-tert-butyl-4-(2-octyl-3-propanoic) phenol; N,N-di(alkylphenyl)amines; and alkylated phenylene-diamines.

The antioxidant component may be a hindered phenolic antioxidant such as butylated hydroxytoluene, suitably present in an amount of 0.01 to 5%, preferably 0.4 to 0.8%, by weight of the lubricant composition. Alternatively, or in addition, component b) may comprise an aromatic amine antioxidant such as mono-octylphenylalphanapthylamine or p,p-dioctyldiphenylamine, used singly or in admixture. The amine anti-oxidant component is suitably present in a range of from 0.01 to 5% by weight of the lubricant composition, more preferably 0.5 to 1.5%.

A sulfur-containing antioxidant may be any and every antioxidant containing sulfur, for example, including dialkyl thiodipropionates such as dilauryl thiodipropionate and distearyl thiodipropionate, dialkyldithiocarbamic acid derivatives (excluding metal salts), bis(3,5-di-t-butyl-4-hydroxybenzyl)sulfide, mercaptobenzothiazole, reaction products of phosphorus pentoxide and olefins, and dicetyl sulfide. Of these, preferred are dialkyl thiodipropionates such as dilauryl thiodipropionate and distearyl thiodipropionate. The amine-type antioxidant includes, for example, monoalkyldiphenylamines such as monooctyldiphenylamine and monononyldiphenylamine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamines such as tetrabutyldiphenylamine, tetrahexyldiphenylamine, tetraoctyldiphenylamine and tetranonyldiphenylamine; and naphthylamines such as alpha-naphthylamine, phenyl-alpha-naphthylamine, butylphenyl-alpha-naphthylamine, pentylphenyl-alpha-naphthylamine, hexylphenyl-alpha-naphthylamine, heptylphenyl-alpha-naphthylamine, octylphenyl-alpha-naphthylamine and nonylphenyl-alpha-naphthylamine. Of these, preferred are dialkyldiphenylamines. The sulfur-containing antioxidant and the amine-type antioxidant are added to the base oil in an amount of from 0.01 to 5% by weight, preferably from 0.03 to 3% by weight, relative to the total weight of the composition.

The oxidation inhibitors that are particularly useful in lube compositions of the disclosure are the hindered phenols (e.g., 2,6-di-(t-butyl)phenol); aromatic amines (e.g., alkylated diphenyl amines); alkyl polysulfides; selenides; borates (e.g., epoxide/boric acid reaction products); phosphorodithioic acids, esters and/or salts; and the dithiocarbamate (e.g., zinc dithiocarbamates). These oxidation inhibitors as well as the oxidation inhibitors discussed above the preferably of the disclosure at levels of 0.05% to 5%, more preferably 0.25 to 2% by weight based on the total weight of such compositions; with ratios of amine/phenolic to be from 1:10 to 10:1 of the mixtures preferred.

The oxidation inhibitors that are also useful in lube compositions of the disclosure are chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)(phosphorodithioate, cadmium dinonylphosphorodithioate, and the reaction of phosphorus pentasulfide with an equimolar mixture of isopropyl alcohol, 4-methyl-2-pentanol, and n-hexyl alcohol.

Oxidation inhibitors, organic compounds containing sulfur, nitrogen, phosphorus and some alkylphenols are also employed. Two general types of oxidation inhibitors are those that react with the initiators, peroxy radicals, and hydroperoxides to form inactive compounds, and those that decompose these materials to form less active compounds. Examples are hindered (alkylated) phenols, e.g. 6-di(tert-butyl)-4-methylphenol[2,6-di(tert-butyl)-p-cresol, DBPC], and aromatic amines, e.g. N-phenyl-alpha-naphthalamine. These are used in turbine, circulation, and hydraulic oils that are intended for extended service.

Examples of amine-based antioxidants include dialkyldiphenylamines such as p,p'-dioctyldiphenylamine (manufactured by the Seiko Kagaku Co. under the trade designation "Nonflex OD-3"), p,p'-di-alpha-methylbenzyl-diphenylamine and N-p-butylphenyl-N-p'-octylphenylamine; monoalkyldiphenylamines such as mono-t-butyldiphenylamine, and monooctyldiphenylamine; bis(dialkylphenyl)amines such as di(2,4-diethylphenyl)amine and di(2-ethyl-4-nonylphenyl)amine; alkylphenyl-1-naphthylamines such as octylphenyl-1-naphthylamine and N-t-dodecylphenyl-1-naphthylamine; arylnaphthylamines such as 1-naphthylamine, phenyl-1-naphthylamine, phenyl-2-naphthylamine, N-hexylphenyl-2-naphthylamine and N-octylphenyl-2-naphthylamine, phenylenediamines such as N,N'-diisopropyl-p-phenylenediamine and N,N'-diphenyl-p-phenylenediamine, and phenothiazines such as phenothiazine (manufactured by the Hodogaya Kagaku Co.: Phenothiazine) and 3,7-dioctylphenothiazine.

Examples of sulfur-based antioxidants include dialkylsulphides such as didodecylsulphide and dioctadecylsulphide; thiodipropionic acid esters such as didodecyl thiodipropionate, dioctadecyl thiodipropionate, dimyristyl thiodipropionate and dodecyloctadecyl thiodipropionate, and 2-mercaptobenzimidazole.

Examples of phenol-based antioxidants include 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,5-di-t-butylhydroquinone (manufactured by the Kawaguchi Kagaku Co. under trade designation "Antage DBH"), 2,6-di-t-butylphenol and 2,6-di-t-butyl-4-alkylphenols such as 2,6-di-t-butyl-4-methylphenol and 2,6-di-t-butyl-4-ethylphenol; 2,6-di-t-butyl-4-alkoxyphenols such as 2,6-di-t-butyl-4-methoxyphenol and 2,6-di-t-butyl-4-ethoxyphenol, 3,5-di-t-butyl-4-hydroxybenzylmercaptoocty-1 acetate, alkyl-3-(3,5-di-t-butyl-4-hydroxyphenyl)propionates such as n-octyl-3-(3,5-di-t-butyl-4-hydroxyphenyl)propionate (manufactured by the Yoshitomi Seiyaku Co. under the trade designation "Yonox SS"), n-dodecyl-3-(3,5-di-t-butyl-4-hydroxyphenyl)propionate and 2'-ethylhexyl-3-(3,5-di-t-butyl-4-hydroxyphenyl)propionate; 2,6-di-t-butyl-alpha-dimethylamino-p-cresol, 2,2'-methylenebis(4-alkyl-6-t-butylphenol) compounds such as 2,2'-methylenebis(4-methyl-6-t-butylphenol) (manufactured by the Kawaguchi Kagaku Co. under the trade designation "Antage W-400") and 2,2'-methylenebis(4-ethyl-6-t-butylphenol) (manufactured by the Kawaguchi Kagaku Co. under the trade designation "Antage W-500"); bisphenols such as 4,4'-butylidenebis(3-methyl-6-t-butyl-phenol) (manufactured by the Kawaguchi Kagaku Co. under the trade designation "Antage W-300"), 4,4'-methylenebis(2,6-di-t-butylphenol) (manufactured by Laporte Performance Chemicals under the trade designation "Ionox 220AH"), 4,4'-bis(2,6-di-t-butylphenol), 2,2-(di-p-hydroxyphenyl)propane (Bisphenol A), 2,2-bis(3,5-di-t-butyl-4-hydroxyphenyl)propane, 4,4'-cyclohexylidenebis(2,6-di-t-butylphenol), hexamethylene glycol bis[3, (3,5-di-t-butyl-4-hydroxyphenyl)propionate] (manufactured by the Ciba Speciality Chemicals Co. under the trade designation "Irganox L109"), triethylene glycol bis[3-(3-t-butyl-4-hydroxy-y-5-methylphenyl)propionate] (manufactured by the Yoshitomi Seiyaku Co. under the trade designation "Tominox 917"), 2,2'-thio[diethyl-3-(3,5-di-t-1-butyl-4-hydroxyphenyl)propionate](manufactured by the Ciba Speciality Chemicals Co. under the trade designation "Irganox L115"), 3,9-bis{1,1-dimethyl-2-[3-(3-t-butyl-4-hydroxy-5-methylphenyl)-propionyloxy]ethyl)}2,4,8,10-tetraoxaspiro[5,5]undecane (manufactured by the Sumitomo Kagaku Co. under the trade designation "Sumilizer GA80") and 4,4'-thiobis(3-methyl-6-t-butylphenol) (manufactured by the Kawaguchi Kagaku Co. under the trade designation "Antage RC"), 2,2'-thiobis(4,6-di-t-butylresorcinol); polyphenols such as tetrakis[methylene-3-(3,5-di-t-butyl-4-hydroxyphenyl)propionato]methane (manufactured by the Ciba Speciality Chemicals Co. under the trade designation "Irganox L101"), 1,1,3-tris(2-methyl-4-hydroxy-5-t-butylpheny-1)butane (manufactured by the Yoshitomi Seiyaku Co. under the trade designation "Yoshinox 930"), 1,3,5-trimethyl-2,4,6-tris(3,5-di-t-butyl-4-hydroxybenzyl)benzene (manufactured by Ciba Speciality Chemicals under the trade designation "Irganox 330"), bis[3,3'-bis(4'-hydroxy-3'-t-butylpheny-1)butyric acid]glycol ester, 2-(3',5'-di-t-butyl-4-hydroxyphenyl)-methyl-4-(2',4'-di-t-butyl-3"-hydroxyphenyl)methyl-6-t-butylphenol and 2,6-bis(2'-hydroxy-3'-t-butyl-5'-methylbenzyl)-4-methylphenol; and phenol/aldehyde condensates such as the condensates of p-t-butylphenol and formaldehyde and the condensates of p-t-butylphenol and acetaldehyde.

Viscosity index improvers and/or the pour point depressant include polymeric alkylmethacrylates and olefinic copolymers such as an ethylene-propylene copolymer or a styrene-butadiene copolymer or polyalkene such as PIB. Viscosity index improvers (VI improvers), high molecular weight polymers that increase the relative viscosity of an oil at high temperatures more than they do at low temperatures. The most common VI improvers are methacrylate polymers and copolymers, acrylate polymers, olefin polymers and copolymers, and styrene-butadiene copolymers.

Other examples of the viscosity index improver include polymethacrylate, polyisobutylene, alpha-olefin polymers, alpha-olefin copolymers (e.g., an ethylene-propylene copolymer), polyalkylstyrene, phenol condensates, naphthalene condensates, a styrenebutadiene copolymer and the like. Of these, polymethacrylate having a number average molecular weight of 10,000 to 300,000, and alpha-olefin polymers or alpha-olefin copolymers having a number average molecular weight of 1,000 to 30,000, particularly ethylene-alpha-olefin copolymers having a number average molecular weight of 1,000 to 10,000 are preferred.

The viscosity index increasing agents which can be used include, for example, polymethacrylates and ethylene/propylene copolymers, other non-dispersion type viscosity index increasing agents such as olefin copolymers like styrene/diene copolymers, and dispersible type viscosity index increasing agents where a nitrogen containing monomer has been copolymerized in such materials. These materials can be added and used individually or in the form of mixtures, conveniently in an amount within the range of from 0.05 to 20 parts by weight per 100 parts by weight of base oil.

Pour point depressors (PPD) include polymethacrylates. Commonly used additives such as alkylaromatic polymers and polymethacrylates are useful for this purpose; typically the treat rates range from 0.001% to 1.0%.

Detergents include calcium alkylsalicylates, calcium alkylphenates and calcium alkarylsulfonates with alternate metal ions used such as magnesium, barium, or sodium. Examples of the cleaning and dispersing agents which can be used include metal-based detergents such as the neutral and basic alkaline earth metal sulfonates, alkaline earth metal phenates and alkaline earth metal salicylates alkenylsuccinimide and alkenylsuccinimide esters and their borohydrides, phenates, salienius complex detergents and ashless dispersing agents which have been modified with sulfur compounds. These agents can be added and used individually or in the form of mixtures, conveniently in an amount within the range of from 0.01 to 1 part by weight per 100 parts by weight of base oil; these can also be high TBN, low TBN, or mixtures of high/low TBN.

Anti-rust additives include (short-chain) alkenyl succinic acids, partial esters thereof and nitrogen-containing derivatives thereof; and synthetic alkarylsulfonates, such as metal dinonylnaphthalene sulfonates. Anti-rust agents include, for example, monocarboxylic acids which have from 8 to 30 carbon atoms, alkyl or alkenyl succinates or partial esters thereof, hydroxy-fatty acids which have from 12 to 30 carbon atoms and derivatives thereof, sarcosines which have from 8 to 24 carbon atoms and derivatives thereof, amino acids and derivatives thereof, naphthenic acid and derivatives thereof, lanolin fatty acid, mercapto-fatty acids and paraffin oxides.

Foam inhibitors include polymers of alkyl methacrylate especially useful poly alkyl acrylate polymers where alkyl is generally understood to be methyl, ethyl propyl, isopropyl, butyl, or iso butyl and polymers of dimethylsilicone which form materials called dimethylsiloxane polymers in the viscosity range of 100 cSt to 100,000 cSt. Other additives are defoamers, such as silicone polymers which have been post reacted with various carbon containing moieties, are the most widely used defoamers. Organic polymers are sometimes used as defoamers although much higher concentrations are required.

Metal deactivating compounds/corrosion inhibitors include 2,5-dimercapto-1,3,4-thiadiazoles and derivatives thereof, mercaptobenzothiazoles, alkyltriazoles and benzotriazoles. Examples of dibasic acids useful as anti-corrosion agents, other than sebacic acids, which may be used in the present disclosure, are adipic acid, azelaic acid, dodecanedioic acid, 3-methyladipic acid, 3-nitrophthalic acid, 1,10-decanedicarboxylic acid, and fumaric acid. The anti-corrosion combination is a straight or branch-chained, saturated or unsaturated monocarboxylic acid or ester thereof which may optionally be sulfurized in an amount up to 35% by weight. Preferably the acid is a $C_4$ to $C_{22}$ straight chain unsaturated monocarboxylic acid. The preferred concentration of this additive is from 0.001% to 0.35% by weight of the total lubricant composition. The preferred monocarboxylic acid is sulfurized oleic acid. However, other suitable materials are oleic acid itself; valeric acid and erucic acid. A component of the anti-corrosion combination is a triazole as previously defined. The triazole should be used at a concentration from 0.005% to 0.25% by weight of the total composition. The preferred triazole is tolylotriazole which may be included in the compositions of the disclosure include triazoles, thiazoles and certain diamine compounds which are useful as metal deactivators or metal passivators. Examples include triazole, benzotriazole and substituted benzotriazoles such as alkyl substituted derivatives. The alkyl substituent generally contains up to 1.5 carbon atoms, preferably up to 8 carbon atoms. The triazoles may contain other substituents on the aromatic ring such as halogens, nitro, amino, mercapto, and the like. Examples of suitable compounds are benzotriazole and the tolyltriazoles, ethylbenzotriazoles, hexylbenzotriazoles, octylbenzotriazoles, chlorobenzotriazoles and nitrobenzotriazoles. Benzotriazole and tolyltriazole are particularly preferred. A straight or branched chain saturated or unsaturated monocarboxylic acid which is optionally sulfurized in an amount which may be up to 35% by weight; or an ester of such an acid; and a triazole or alkyl derivatives thereof, or short chain alkyl of up to 5 carbon atoms; n is zero or an integer between 1 and 3 inclusive, and is hydrogen, morpholino, alkyl, amido, amino, hydroxy or alkyl or aryl substituted derivatives thereof; or a triazole selected from 1,2,4-triazole, 1,2,3-triazole, 5-anilo-1,2,3,4-thiatriazole, 3-amino-1,2,4-triazole, 1-H-benzotriazole-1-yl-methylisocyanide, methylene-bis-benzotriazole and naphthotriazole.

Alkyl is straight or branched chain and is for example methyl, ethyl, n-propyl, iso-propyl, n-butyl, sec-butyl, n-pentyl, n-hexyl, n-heptyl, n-octyl, 2-ethylhexyl, n-nonyl, n-decyl, n-dodecyl, n-tetradecyl, n-hexadecyl, n-octadecyl or n-eicosyl.

Alkenyl is straight or branched chain and is, for example, prop-2-enyl, but-2-enyl, 2-methyl-prop-2-enyl, pent-2-enyl, hexa-2,4-dienyl, dec-10-enyl or eicos-2-enyl.

Cylcoalkyl is for example cyclopentyl, cyclohexyl, cyclooctyl, cyclodecyl, adamantyl or cyclododecyl.

Aralkyl is for example benzyl, 2-phenylethyl, benzhydryl or naphthylmethyl. Aryl is for example phenyl or naphthyl.

The heterocyclic group is for example a morpholine, pyrrolidine, piperidine or a perhydroazepine ring.

Alkylene moieties include for example methylene, ethylene, 1:2- or 1:3-propylene, 1:4-butylene, 1:6-hexylene, 1:8-octylene, 1:10-decylene and 1:12-dodecylene.

Arylene moieties include for example phenylene and naphthylene, 1-(or 4)-(dimethylaminomethyl)triazole, 1-(or 4)-(diethylaminomethyl)triazole, 1-(or 4)-(di-isopropylaminomethyl)triazole, 1-(or 4)-(di-n-butylaminomethyl)triazole, 1-(or 4)-(di-n-hexylaminomethyl)triazole, 1-(or 4)-(di-isooctylaminomethyl)triazole, 1-(or 4)-(di-(2-ethylhexyl) aminomethyl)triazole, 1-(or 4)-(di-n-decylaminomethyl) triazole, 1-(or 4)-(di-n-dodecylaminomethyl)triazole, 1-(or 4)-(di-n-octadecylaminomethyl)triazole, 1-(or 4)-(di-n-eicosylaminomethyl)triazole, 1-(or 4)-[di-(prop-2'-enyl)aminomethyl]triazole, 1-(or 4)-[di-(but-2'-enyl)aminomethyl]triazole, 1-(or 4)-[di-(eicos-2'-enyl)aminomethyl]triazole, 1-(or 4)-(di-cyclohexylaminomethyl)triazole, 1-(or 4)-(di-benzylaminomethyl)triazole, 1-(or 4)-(di-phenylaminomethyl)triazole, 1-(or 4)-(4'-morpholinomethyl)triazole, 1-(or 4)-(1'-pyrrolidinomethyl)triazole, 1-(or 4)-(1'-piperidinomethyl)triazole, 1-(or 4)-(1'-perhydroroazepinomethyl)triazole, 1-(or 4)-(2',2"-dihydroxyethyl)aminomethyl]triazole, 1-(or 4)-(dibutoxypropyl-aminomethyl)triazole, 1-(or 4)-(dibutylthiopropyl-aminomethyl)triazole, 1-(or 4)-(di-butylaminopropyl-aminomethyl)triazole, 1-(or -4)-(1-methanomine)-N,N-bis(2-ethylhexyl)-methyl benzotriazole, N,N-bis-(1- or 4-triazolylmethyl)laurylamine, N,N-bis-(1- or 4-triazolylmethyl)oleylamine, N,N-bis-(1- or 4-triazolylmethyl)ethanolamine and N,N,N',N'-tetra(1- or 4-triazolylmethyl)ethylene diamine.

Also, dihydrocarbyl dithiophosphate metal salts where the metal is aluminum, lead, tin, manganese, molybdenum, antimony, cobalt, nickel, zinc or copper, but most often zinc. Sulfur- and/or phosphorus- and/or halogen-containing compounds, such as sulfurized olefins and vegetable oils, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, di(2-ethylhexyl)-aminomethyltolyltriazole, derivatives of 2,5-dimercapto-1,3,4-thiadiazole, ethyl ((bisisopropyloxyphosphinothioyl)-thio) propionate, triphenyl thiophosphate (triphenyl phosphorothioate), tris(alkylphenyl)phosphorothioates and mixtures thereof (for example tris(isononylphenyl)phosphorothioate), diphenylmonononylphenyl phosphorothioate, isobutylphenyl diphenyl phosphorothioate, the dodecylamine salt of 3-hydroxy-1,3-thiaphosphetan 3-oxide, trithiophosphoric acid 5,5,5-tris(isooctyl 2-acetate), derivatives of 2-mercaptobenzothiazole, such as 1-(N,N-bis(2-ethylhexyl) aminomethyl)-2-mercapto-1H-1,3-benzothiazole or ethoxycarbonyl 5-octyldithiocarbamate.

The metal deactivating agents which can be used in the lubricating oil a composition of the present disclosure include benzotriazole and the 4-alkylbenzotriazoles such as 4-methylbenzotriazole and 4-ethylbenzotriazole; 5-alkylbenzotriazoles such as 5-methylbenzotriazole, 5-ethylbenzotriazole; 1-alkylbenzotriazoles such as 1-dioctylauainomethyl-2,3-benzotriazole; benzotriazole derivatives such as the 1-alkyltolutriazoles, for example, 1-dioctylaminomethyl-2,3-tolutriazole; benzimidazole and benzimidazole derivatives such as 2-(alkyldithio)-benzimidazoles, for example, such as 2-(octyldithio)-benzimidazole, 2-(decyldithio)benzimidazole and 2-(dodecyldithio)-benzimidazole; 2-(alkyldithio)-toluimidazoles such as 2-(octyldithio)-toluimidazole, 2-(decyldithio)-toluimidazole and 2-(dodecyldithio)-toluimidazole; indazole and indazole derivatives of toluimidazoles such as 4-alkylindazole, 5-alkylindazole; benzothiazole, 2-mercaptobenzothiazole derivatives (manufactured by the Chiyoda Kagaku Co. under the trade designation "Thiolite B-3100") and 2-(alkyldithio)benzothiazoles such as 2-(hexyldithio)benzothiazole and 2-(octyldithio) benzothiazole; 2-(alkyl-dithio)toluthiazoles such as 2-(benzyldithio)toluthiazole and 2-(octyldithio)toluthiazole, 2-(N,N-dialkyldithiocarbamyl)benzothiazoles such as 2-(N,N-diethyldithiocarbamyl)benzothiazole, 2-(N,N-dibutyldithiocarbamyl)benzotriazole and 2-N,N-dihexyldithiocarbamyl)benzotriazole; benzothiazole derivatives of 2-(N,N-dialkyldithiocarbamyl)toluthiazoles such as 2-(N,N-diethyldithiocarbamyl)toluthiazole, 2-(N,N-dibutyldithiocarbamyl)toluthiazole, 2-(N,N-dihexyl-dithiocarbamyl)-toluthiazole; 2-(alkyldithio)benzoxazoles such as 2-(octyldithio)benzoxazole, 2-(decyldithio)-benzoxazole and 2-(dodecyldithio)benzoxazole; benzoxazole derivatives of 2-(alkyldithio)toluoxazoles such as 2-(octyldithio)toluoxazole, 2-(decyldithio)toluoxazole, 2-(dodecyldithio)toluoxazole; 2,5-bis(alkyldithio)-1,3,4-thiadiazoles such as 2,5-bis (heptyldithio)-1,3,4-thiadiazole, 2,5-bis(nonyldithio)-1,3,4-thiadiazole, 2,5-bis(dodecyldithio)-1,3,4-thiadiazole and 2,5-bis-(octadecyldithio)-1,3,4-thiadiazole; 2,5-bis(N,N-dialkyl-dithiocarbamyl)-1,3,4-thiadiazoles such as 2,5-bis(N,N-diethyldithiocarbamyl)-1,3,4-thiadiazole, 2,5-bis(N,N-dibutyldithiocarbamyl)-1,3,4-thiadiazole and 2,5-bis(N,N-dioctyldithiocarbamyl)1,3,4-thiadiazole; thiadiazole derivatives of 2-N,N-dialkyldithiocarbamyl-5-mercapto-1,3,4-thiadiazoles such as 2-N,N-dibutyldithiocarbamyl-5-mercapto-1,3,4-thiadiazole and 2-N,N-dioctyldithiocarbamyl-5-mercapto-1,3,4-thiadiazole, and triazole derivatives of 1-alkyl-2,4-triazoles such as 1-dioctylaminomethyl-2,4-triazole or concentrates and/or mixtures thereof.

Anti-wear agents/extreme pressure agent/friction reducer: zinc alkyldithiophosphates, aryl phosphates and phosphites, sulfur-containing esters, phosphosulfur compounds, and metal or ash-free dithiocarbamates.

A phosphate ester or salt may be a monohydrocarbyl, dihydrocarbyl or a trihydrocarbyl phosphate, wherein each hydrocarbyl group is saturated. In one embodiment, each hydrocarbyl group independently contains from 8 to 30, or from 12 up to 28, or from 14 up to 24, or from 14 up to 18 carbons atoms. In one embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

A phosphate ester or salt is a phosphorus acid ester prepared by reacting one or more phosphorus acid or anhydride with a saturated alcohol. The phosphorus acid or anhydride is generally an inorganic phosphorus reagent, such as phosphorus pentoxide, phosphorus trioxide, phosphorus tetroxide, phosphorous acid, phosphoric acid, phosphorus halide, lower phosphorus esters, or a phosphorus sulfide, including phosphorus pentasulfide, and the like. Lower phosphorus acid esters generally contain from 1 to 7 carbon atoms in each ester group. Alcohols used to prepare the phosphorus acid esters or salts. Examples of commercially available alcohols and alcohol mixtures include Alfol 1218 (a mixture of synthetic, primary, straight-chain alcohols containing 12 to 18 carbon atoms); Alfol 20+ alcohols (mixtures of $C_{18}$-$C_{28}$ primary alcohols having mostly $C_{20}$ alcohols as determined by GLC (gas-liquid-chromatography)); and Alfol22+ alcohols ($C_{18}$-$C_{28}$ primary alcohols containing primarily $C_{22}$ alcohols). Alfol alcohols are available from Continental Oil Company. Another example of a commercially available alcohol mixture is Adol 60 (75% by weight of a straight chain $C_{22}$ primary alcohol, 15% of a $C_{20}$ primary alcohol and 8% of $C_{18}$ and $C_{24}$ alcohols). The Adol alcohols are marketed by Ashland Chemical.

A variety of mixtures of monohydric fatty alcohols derived from naturally occurring triglycerides and ranging in chain length from C8 to C18 are available from Procter & Gamble Company. These mixtures contain various amounts of fatty alcohols containing 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ to $C_{15}$ alcohols; and Neodol 45 is a mixture of $C_{14}$ to $C_{15}$ linear alcohols. The phosphate contains from 14 to 18 carbon atoms in each hydrocarbyl group. The hydrocarbyl groups of the phosphate are generally derived from a mixture of fatty alcohols having from 14 up to 18 carbon atoms. The hydrocarbyl phosphate may also be derived from a fatty vicinal diol.

Fatty vicinal diols include those available from Ashland Oil under the general trade designation Adol 114 and Adol 158. The former is derived from a straight chain alpha olefin fraction of $C_{11}$-$C_{14}$, and the latter is derived from a $C_{15}$-$C_{18}$ fraction.

The phosphate salts may be prepared by reacting an acidic phosphate ester with an amine compound or a metallic base to form an amine or a metal salt. The amines may be monoamines or polyamines. Useful amines include those amines disclosed in U.S. Pat. No. 4,234,435.

The monoamines generally contain a hydrocarbyl group which contains from 1 to 30 carbon atoms, or from 1 to 12, or from 1 to 6. Examples of primary monoamines useful in the present disclosure include methylamine, ethylamine, propylamine, butylamine, cyclopentylamine, cyclohexylamine, octylamine, dodecylamine, allylamine, cocoamine, stearylamine, and laurylamine Examples of secondary monoamines include dimethylamine, diethylamine, dipropylamine, dibutylamine, dicyclopentylamine, dicyclohexylamine, methylbutylamine, ethylhexylamine, and the like.

An amine is a fatty ($C_{8-30}$) amine which includes n-octylamine, n-decylamine, n-dodecylamine, n-tetradecylamine, n-hexadecylamine, n-octadecylamine, oleyamine, and the like. Also useful fatty amines include commercially available fatty amines such as "Armeen" amines (products available from Akzo Chemicals, Chicago, Ill.), such Armeen C, Armeen O, Armeen OL, Armeen T, Armeen HT, Armeen S and Armeen SD, wherein the letter designation relates to the fatty group, such as coco, oleyl, tallow, or stearyl groups.

Other useful amines include primary ether amines, such as those represented by the formula, R"(OR')x $NH_2$, wherein R' is a divalent alkylene group having 2 to 6 carbon atoms; x is a number from one to 150, or from one to five, or one; and R" is a hydrocarbyl group of 5 to 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear $C_{16}$), SURFAM P17B (tridecyloxypropylamine). The carbon chain lengths (i.e., $C_{14}$, and the like) of the SURFAMS described above and used hereinafter are approximate and include the oxygen ether linkage.

An amine is a tertiary-aliphatic primary amine. Generally, the aliphatic group, preferably an alkyl group, contains from 4 to 30, or from 6 to 24, or from 8 to 22 carbon atoms. Usually the tertiary alkyl primary amines are monoamines the alkyl group is a hydrocarbyl group containing from one to 27 carbon atoms or a hydrocarbyl group containing from 1 to 12 carbon atoms. Such amines are illustrated by tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine. Mixtures of tertiary aliphatic amines may also be used in preparing the phosphate salt. Illustrative of amine mixtures of this type are "Primene 81R" which is a mixture of $C_{11}$-$C_{14}$ tertiary alkyl primary amines and "Primene JMT" which is a similar mixture of $C_{18}$-$C_{22}$ tertiary alkyl primary amines (both are available from Rohm and Haas Company). The tertiary aliphatic primary amines and methods for their preparation are known to those of ordinary skill in the art. An amine is a heterocyclic polyamine. The heterocyclic polyamines include aziridines, azetidines, azolidines, tetra- and dihydropyridines, pyrroles, indoles, piperidines, imidazoles, di- and tetra-hydroimidazoles, piperazines, isoindoles, purines, morpholines, thiomorpholines, N-aminoalkylmorpholines, N-aminoalkylthiomorpholines, N-aminoalkyl-piperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

The metal salts of the phosphorus acid esters are prepared by the reaction of a metal base with the acidic phosphorus ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, Group IIB metal, such as zinc, or a Group VIIB metal, such as manganese. Preferably, the metal is magnesium, calcium, manganese or zinc. Examples of metal compounds which may be reacted with the phosphorus acid include zinc hydroxide, zinc oxide, copper hydroxide, copper oxide, and the like.

Lubricating compositions also may include a fatty imidazoline or a reaction product of a fatty carboxylic acid and at least one polyamine. The fatty imidazoline has fatty substituents containing from 8 to 30, or from 12 to 24 carbon atoms. The substituent may be saturated or unsaturated for example, heptadeceneyl derived olyel groups, preferably saturated. In one aspect, the fatty imidazoline may be prepared by reacting a fatty carboxylic acid with a polyalkylenepolyamine, such as those discussed above. The fatty carboxylic acids are generally mixtures of straight and branched chain fatty carboxylic acids containing 8 to 30 carbon atoms, or from 12 to 24, or from 16 to 18. Carboxylic acids include the polycarboxylic acids or carboxylic acids or anhydrides having from 2 to 4 carbonyl groups, preferably 2. The polycarboxylic acids include succinic acids and anhydrides and Diels-Alder reaction products of unsaturated monocarboxylic acids with unsaturated carboxylic acids (such as acrylic, methacrylic, maleic, fumaric, crotonic and itaconic acids). Preferably, the fatty carboxylic acids are fatty monocarboxylic acids, having from 8 to 30, preferably 12 to 24 carbon atoms, such as octanoic, oleic, stearic, linoleic, dodecanoic, and tall oil acids, preferably stearic acid. The fatty carboxylic acid is reacted with at least one polyamine. The polyamines may be aliphatic, cycloaliphatic, heterocyclic or aromatic. Examples of the polyamines include alkylene polyamines and heterocyclic polyamines.

Hydroxyalkyl groups are to be understood as meaning, for example, monoethanolamine, diethanolamine or triethanolamine, and the term amine also includes diamine. The amine used for the neutralization depends on the phosphoric esters used. The EP additive according to the disclosure has the following advantages: It very high effectiveness when used in low concentrations and it is free of chlorine. For the neutralization of the phosphoric esters, the latter are taken and the corresponding amine slowly added with stirring. The resulting heat of neutralization is removed by cooling. The EP additive according to the disclosure can be incorporated into the respective base liquid with the aid of fatty substances (e.g. tall oil fatty acid, oleic acid, and the like) as solubilizers. The base liquids used are napthenic or paraffinic base oils, synthetic oils (e.g. polyglycols, mixed polyglycols), polyolefins, carboxylic esters, and the like.

The composition comprises at least one phosphorus containing extreme pressure additive. Examples of such additives are amine phosphate extreme pressure additives such as that known under the trade name IRGALUBE® 349 and/or triphenyl phosphorothionate extreme pressure/antiwear additives such as that known under the trade name IRGALUBE TPPT. Such amine phosphates are suitably present in an amount of from 0.01 to 2%, preferably 0.2 to 0.6% by weight of the lubricant composition while such phosphorothionates are suitably present in an amount of from 0.01 to 3%, preferably 0.5 to 1.5% by weight of the lubricant composition. A mixture of an amine phosphate and phosphorothionate is employed.

At least one straight and/or branched chain saturated or unsaturated monocarboxylic acid which is optionally sulfurized in an amount which may be up to 35% by weight; and/or an ester of such an acid. At least one triazole or alkyl derivatives thereof, or short chain alkyl of up to 5 carbon atoms and is hydrogen, morphilino, alkyl, amido, amino, hydroxy or alkyl or aryl substituted derivatives thereof; or a triazole selected from 1,2,4-triazole, 1,2,3-triazole, 5-anilo-1,2,3,4-thiatriazole, 3-amino-1,2,4-triazole, 1-H-benzotriazole-1-yl-methylisocyanide, methylene-bis-benzotriazole and naphthotriazole; and the neutral organic phosphate which forms a component of the formulation may be present in an amount of 0.01 to 4%, preferably 1.5 to 2.5% by weight of the composition. The above amine phosphates and any of the aforementioned benzo- or tolyltriazoles can be mixed together to form a single component capable of delivering antiwear performance. The neutral organic phosphate is also a conventional ingredient of lubricating compositions and any such neutral organic phosphate falling within the formula as previously defined may be employed.

Phosphates for use in the present disclosure include phosphates, acid phosphates, phosphites and acid phosphites. The phosphates include triaryl phosphates, trialkyl phosphates, trialkylaryl phosphates, triarylalkyl phosphates and trialkenyl phosphates. As specific examples of these, referred to are triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, trihexyl phosphate, tri(2-ethylhexyl)phosphate, tridecyl phosphate, trilauryl phosphate, trimyristyl phosphate, tripalmityl phosphate, tristearyl phosphate, and trioleyl phosphate. The acid phosphates include, for example, 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate. The phosphites include, for example, triethyl phosphite, tributyl phosphite, triphenyl phosphite, tricresyl phosphite, tri(nonylphenyl) phosphite, tri(2-ethylhexyl)phosphite, tridecyl phosphite, trilauryl phosphite, triisooctyl phosphite, diphenylisodecyl phosphite, tristearyl phosphite, and trioleyl phosphate.

The acid phosphites include, for example, dibutyl hydrogenphosphite, dilauryl hydrogenphosphite, dioleyl hydrogenphosphite, distearyl hydrogenphosphite, and diphenyl hydrogenphosphite.

Amines that form amine salts with such phosphates include, for example, mono-substituted amines, di-substituted amines and tri-substituted amines. Examples of the mono-substituted amines include butylamine, pentylamine, hexylamine, cyclohexylamine, octylamine, laurylamine, stearylamine, oleylamine and benzylamine; and those of the di-substituted amines include dibutylamine, dipentylamine, dihexylamine, dicyclohexylamine, dioctylamine, dilaurylamine, distearylamine, dioleylamine, dibenzylamine, stearyl monoethanolamine, decyl monoethanolamine, hexyl monopropanolamine, benzyl monoethanolamine, phenyl monoethanolamine, and tolyl monopropanolamine. Examples of tri-substituted amines include tributylamine, tripentylamine, trihexylamine, tricyclohexylamine, trioctylamine, trilaurylamine, tristearylamine, trioleylamine, tribenzylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, lauryl diethanolamine, octyl dipropanolamine, butyl diethanolamine, benzyl diethanolamine, phenyl diethanolamine, tolyl dipropanolamine, xylyl diethanolamine, triethanolamine, and tripropanolamine. Phosphates or their amine salts are added to the base oil in an amount of from 0.03 to 5% by weight, preferably from 0.1 to 4% by weight, relative to the total weight of the composition.

Carboxylic acids to be reacted with amines include, for example, aliphatic carboxylic acids, dicarboxylic acids (dibasic acids), and aromatic carboxylic acids. The aliphatic carboxylic acids have from 8 to 30 carbon atoms, may be saturated or unsaturated, and linear or branched. Specific examples of the aliphatic carboxylic acids include pelargonic acid, lauric acid, tridecanoic acid, myristic acid, palmitic acid, stearic acid, isostearic acid, eicosanoic acid, behenic acid, triacontanoic acid, caproleic acid, undecylenic acid, oleic acid, linolenic acid, erucic acid, and linoleic acid. Specific examples of the dicarboxylic acids include octadecylsuccinic acid, octadecenylsuccinic acid, adipic acid, azelaic acid, and sebacic acid. One example of the aromatic carboxylic acids is salicylic acid. The amines to be reacted with carboxylic acids include, for example, polyalkylenepolyamines such as diethylenetriamine, triethylenetetramine, tetraethylenepentamine, pentaethylenehexamine, hexaethyleneheptamine, heptaethyleneoctamine, dipropylenetriamine, tetrapropylenepentamine, and hexabutylencheptamine; and alkanolamines such as monoethanolamine and diethanolamine. Of these, preferred are a combination of isostearic acid and tetraethylenepentamine, and a combination of oleic acid and diethanolamine. The reaction products of carboxylic acids and amines are added to the base oil in an amount of from 0.01 to 5% by weight, preferably from 0.03 to 3% by weight, relative to the total weight of the composition.

Important components are phosphites, thiophosphites phosphates, and thiophosphates, including mixed materials having, for instance, one or two sulfur atoms. i.e., monothio- or dithio-compounds. As used herein, the term "hydrocarbyl substituent" or "hydrocarbyl group" is used in its ordinary sense, which is well known to those skilled in the art. Specifically, it refers to a group having a carbon atom directly attached to the remainder of the molecule and having predominantly hydrocarbon character.

Examples of hydrocarbyl groups include: hydrocarbon substituents, that is, aliphatic (e.g. alkyl or alkenyl), alicyclic (e.g., cycloalkyl, cycloalkenyl) substituents, and aromatic, aliphatic-, alicyclic-substituted aromatic substituents, as well as cyclic substituents wherein the ring is completed through another portion of the molecule (e.g., two substituents together form an alicyclic radical); the substituted hydrocarbon substituents, that is, substituents containing non-hydrocarbon groups which, in the context of this disclosure, do not alter the predominantly hydrocarbon substituent (e.g., halo (especially chloro and fluoro), hydroxy, alkoxy, mercapto, alkylmercapto, nitro, nitroso, and sulfoxy); and hetero-atom containing substituents, that is, substituents which, while having a predominantly hydrocarbon character, in the context of this disclosure, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The term "hydrocarbyl group," in the context of the present disclosure, is also intended to encompass cyclic hydrocarbyl or hydrocarbylene groups, where two or more of the alkyl groups in the above structures together form a cyclic structure. The hydrocarbyl or hydrocarbylene groups of the present disclosure generally are alkyl or cycloalkyl groups which contain at least 3 carbon atoms. Preferably or optimally containing sulfur, nitrogen, or oxygen, they will contain 4 to 24, and alternatively 5 to 18 carbon atoms. In another embodiment they contain 6, or exactly 6 carbon atoms. The hydrocarbyl groups can be tertiary or preferably primary or secondary groups; in one embodiment the component is a di(hydrocarbyl)hydrogen phosphite and each of the hydrocarbyl groups is a primary alkyl group; in another embodiment the component is a di(hydrocarbyl)hydrogen phosphite and each of the hydrocarbyl groups is a secondary alkyl group. In yet another embodiment the component is a hydrocarbylenehydrogen phosphate.

Examples of straight chain hydrocarbyl groups include methyl, ethyl, n-propyl, n-butyl, n-hexyl, n-octyl, n-decyl, n-dodecyl, n-tetradecyl, stearyl, n-hexadecyl, n-octadecyl, oleyl, and cetyl. Examples of branched-chain hydrocarbon groups include isopropyl, isobutyl, secondary butyl, tertiary butyl, neopentyl, 2-ethylhexyl, and 2,6-dimethylheptyl. Examples of cyclic groups include cyclobutyl, cyclopentyl, methylcyclopentyl, cyclohexyl, methylcyclohexyl, cycloheptyl, and cyclooctyl. A few examples of aromatic hydrocarbyl groups and mixed aromatic-aliphatic hydrocarbyl groups include phenyl, methylphenyl, tolyl, and naphthyl.

The hydrocarbyl groups can also comprise a mixture of hydrocarbyl groups derived from commercial alcohols. Examples of some monohydric alcohols and alcohol mixtures include the commercially available "Alfol™" alcohols marketed by Continental Oil Corporation. Alfol™ 810, for instance, is a mixture containing alcohols consisting essentially of straight chain, primary alcohols having from 8 to 12 carbon atoms. Alfol™ 12 is a mixture of mostly $C_{12}$ fatty alcohols; Alfol™ 22+ comprises $C_{18-28}$ primary alcohols having mostly $C_{22}$ alcohols, and so on. Various mixtures of monohydric fatty alcohols derived from naturally occurring triglycerides and ranging in chain length from $C_8$ to $C_{18}$ are available from Procter & Gamble Company. "Neodol™" alcohols are available from Shell Chemical Co., where, for instance, Neodol™ 25 is a mixture of $C_{12}$ to $C_{15}$ alcohols.

Specific examples of some of the phosphites and thiophosphites within the scope of the disclosure include phosphorous acid, mono-, di-, or tri-thiophosphorous acid, mono-, di-, or tri-propyl phosphite or mono-, di-, or tri-thiophosphite; mono-, di-, or tri-butyl phosphite or mono-, di-, or tri-thiophosphite; mono-, di-, or tri-amyl phosphite or mono-, di-, or tri-thiophosphite; mono-, di-, or tri-hexyl phosphite or mono-, di-, or tri-thiophosphite; mono-, di-, or tri-phenyl phosphite or mono-, di-, or tri-thiophosphite; mono-, di-, or tri-tolyl phosphite or mono-, di-, or tri-thiophosphite; mono-, di-, or tri-cresyl phosphite or mono-, di-, or tri-thiophosphite; dibutyl phenyl phosphite or mono-, di-, or tri-phosphite, amyl dicresyl phosphite or mono-, di-, or tri-thiophosphite, and any of the above with substituted groups, such as chlorophenyl or chlorobutyl.

Specific examples of the phosphates and thiophosphates within the scope of the disclosure include phosphoric acid, mono-, di-, tri-thiophosphoric acid, mono-, di-, or tri-propyl phosphate or mono-, di-, or tri-thiophosphate; mono-, di-, or tri-butyl phosphate or mono-, di-, or tri-thiophosphate; mono-, di-, or tri-amyl phosphate or mono-, di-, or tri-thiophosphate; mono-, di-, or tri-hexyl phosphate or mono-, di-, or tri-thiophosphate; mono-, di-, or tri-phenyl phosphate or mono-, di-, or tri-thiophosphate; mono-, di-, or tritolyl phosphate or mono-, di-, or trithiophosphate; mono-, di-, or tri-cresyl phosphate or mono-, di-, or tri-thiophosphate; dibutyl phenyl phosphate or mono-, di-, or tri-phosphate, amyl dicresyl phosphate or mono-, di-, or tri-thiophosphate, and any of the above with substituted groups, such as chlorophenyl or chlorobutyl.

The phosphorus compounds of the present disclosure are prepared by well-known reactions. One route the reaction of an alcohol or a phenol with phosphorus trichloride or by a transesterification reaction. Alcohols and phenols can be reacted with phosphorus pentoxide to provide a mixture of an alkyl or aryl phosphoric acid and a dialkyl or diaryl phosphoric acid. Alkyl phosphates can also be prepared by the oxidation of the corresponding phosphites. Thiophosphates can be prepared by the reaction of phosphites with elemental sulfur. In any case, the reaction can be conducted with moderate heating. Moreover, various phosphorus esters can be prepared by reaction using other phosphorus esters as starting materials. Thus, medium chain ($C_9$ to $C_{22}$) phosphorus esters have been prepared by reaction of dimethylphosphite with a mixture of medium-chain alcohols by means of a thermal transesterification or an acid- or base-catalyzed transesterification; see for example U.S. Pat. No. 4,652,416. Most such materials are also commercially available; for instance, triphenyl phosphite is available from Albright and Wilson as Duraphos TPP™; di-n-butyl hydrogen phosphite from Albright and Wilson as Duraphos DBHP™; and triphenylthiophosphate from Ciba Specialty Chemicals as Irgalube TPPT™.

The other major component of the present composition is a hydrocarbon having ethylenic unsaturation. This would normally be described as an olefin or a diene, triene, polyene, and so on, depending on the number of ethylenic unsaturations present. Preferably the olefin is mono unsaturated, that is, containing only a single ethylenic double bond per molecule. The olefin can be a cyclic or a linear olefin. If a linear olefin, it can be an internal olefin or an alpha-olefin.

The olefin can also contain aromatic unsaturation, i.e., one or more aromatic rings, provided that it also contains ethylenic (non-aromatic) unsaturation.

The olefin normally will contain 6 to 30 carbon atoms. Olefins having significantly fewer than 6 carbon atoms tend to be volatile liquids or gases which are not normally suitable for formulation into a composition suitable as an antiwear lubricant. Preferably the olefin will contain 6 to 18 or 6 to 12 carbon atoms, and alternatively 6 or 8 carbon atoms.

Among suitable olefins are alkyl-substituted cyclopentenes, hexenes, cyclohexene, alkyl-substituted cyclohexenes, heptenes, cycloheptenes, alkyl-substituted cycloheptenes, octenes including diisobutylene, cyclooctenes, alkyl-substituted cyclooctenes, nonenes, decenes, undecenes, dodecenes including propylene tetramer, tridecenes, tetradecenes, pentadecenes, hexadecenes, heptadecenes, octadecenes, cyclooctadiene, norbornene, dicyclopentadiene, squalene, diphenylacetylene, and styrene. Highly preferred olefins are cyclohexene and 1-octene.

Examples of esters of the dialkylphosphorodithioic acids include esters obtained by reaction of the dialkyl phosphorodithioic acid with an alpha, beta-unsaturated carboxylic acid (e.g., methyl acrylate) and, optionally an alkylene oxide such as propylene oxide.

Generally, the compositions of the present disclosure will contain varying amounts of one or more of the above-identified metal dithiophosphates such as from 0.01 to 2% by weight, and more generally from 0.01 to 1% by weight, based on the weight of the total composition.

The hydrocarbyl in the dithiophosphate may be alkyl, cycloalkyl, aralkyl or alkaryl groups, or a substantially hydrocarbon group of similar structure. Illustrative alkyl groups include isopropyl, isobutyl, n-butyl, sec-butyl, the various amyl groups, n-hexyl, methylisobutyl, heptyl, 2-ethylhexyl, diisobutyl, isooctyl, nonyl, behenyl, decyl, dodecyl, tridecyl, and the like. Illustrative lower alkylphenyl groups include butylphenyl, amylphenyl, heptylphenyl, and the like. Cycloalkyl groups likewise are useful and these include chiefly cyclohexyl and the lower alkyl-cyclohexyl radicals. Many substituted hydrocarbon groups may also be used, e.g., chloropentyl, dichlorophenyl, and dichlorodecyl.

The phosphorodithioic acids from which the metal salts useful in this disclosure are prepared are well known. Examples of dihydrocarbylphosphorodithioic acids and metal salts, and processes for preparing such acids and salts are found in, for example U.S. Pat. Nos. 4,263,150; 4,289,635; 4,308,154; and 4,417,990. These patents are hereby incorporated by reference.

The phosphorodithioic acids are prepared by the reaction of a phosphorus sulfide with an alcohol or phenol or mixtures of alcohols. A typical reaction involves four moles of the alcohol or phenol and one mole of phosphorus pentasulfide, and may be carried out within the temperature range from 50° C. to 200° C. Thus, the preparation of O,O-di-n-hexyl phosphorodithioic acid involves the reaction of a mole of phosphorus pentasulfide with four moles of n-hexyl alcohol at 100° C. for two hours. Hydrogen sulfide is liberated and the residue is the desired acid. The preparation of the metal salts of these acids may be effected by reaction with metal compounds as well known in the art.

The metal salts of dihydrocarbyldithiophosphates which are useful in this disclosure include those salts containing Group I metals, Group II metals, aluminum, lead, tin, molybdenum, manganese, cobalt, and nickel. The Group II metals, aluminum, tin, iron, cobalt, lead, molybdenum, manganese, nickel and copper are among the preferred metals. Zinc and copper are especially useful metals. Examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, lead hydroxide, tin butylate, cobalt hydroxide, nickel hydroxide, nickel carbonate, and the like.

In some instances, the incorporation of certain ingredients such as small amounts of the metal acetate or acetic acid in conjunction with the metal reactant will facilitate the reaction and result in an improved product. For example, the use of up to 5% of zinc acetate in combination with the required amount of zinc oxide facilitates the formation of a zinc phosphorodithioate with potentially improved performance properties.

Especially useful metal phosphorodithioates can be prepared from phosphorodithioic acids which in turn are prepared by the reaction of phosphorus pentasulfide with mixtures of alcohols. In addition, the use of such mixtures enables the utilization of less expensive alcohols which individually may not yield oil-soluble phosphorodithioic acids. Thus a mixture of isopropyl and hexylalcohols can be used to produce a very effective, oil-soluble metal phosphorodithioate. For the same reason mixtures of phosphorodithioic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 2-methyl-4-pentanol; isopropanol and sec-butyl alcohol; isopropanol and isooctyl alcohol; and the like.

Organic triesters of phosphorus acids are also employed in lubricants. Typical esters include triarylphosphates, trialkyl phosphates, neutral alkylaryl phosphates, alkoxyalkyl phosphates, triaryl phosphite, trialkylphosphite, neutral alkyl aryl phosphites, neutral phosphonate esters and neutral phosphine oxide esters. In one embodiment, the long chain dialkyl phosphonate esters are used. More preferentially, the dimethyl-, diethyl-, and dipropyl-oleyl phosphonates can be used. Neutral acids of phosphorus acids are the triesters rather than an acid (HO—P) or a salt of an acid.

Any $C_4$ to $C_8$ alkyl or higher phosphate ester may be employed in the disclosure. For example, tributyl phosphate (TBP) and tri isooctal phosphate (TOF) can be used. The specific triphosphate ester or combination of esters can easily be selected by one skilled in the art to adjust the density, viscosity and the like, of the formulated fluid. Mixed esters, such as dibutyl octyl phosphate or the like may be employed rather than a mixture of two or more trialkyl phosphates.

A trialkyl phosphate is often useful to adjust the specific gravity of the formulation, but it is desirable that the specific trialkyl phosphate be a liquid at low temperatures. Consequently, a mixed ester containing at least one partially alkylated with a $C_3$ to $C_4$ alkyl group is very desirable, for example, 4-isopropylphenyl diphenyl phosphate or 3-butylphenyl diphenyl phosphate. Even more desirable is a triaryl phosphate produced by partially alkylating phenol with butylene or propylene to form a mixed phenol which is then reacted with phosphorus oxychloride as taught in U.S. Pat. No. 3,576,923.

Any mixed triaryl phosphate (TAP) esters may be used as cresyl diphenyl phosphate, tricresyl phosphate, mixed xylyl cresyl phosphates, lower alkylphenyl/phenyl phosphates, such as mixed isopropylphenyl/phenyl phosphates, t-butylphenyl phenyl phosphates. These esters are used extensively as plasticizers, functional fluids, gasoline additives, flame-retardant additives and the like.

An extreme pressure agent, sulfur-based extreme pressure agents, such as sulfides, sulfoxides, sulfones, thiophosphinates, thiocarbonates, sulfurized fats and oils, sulfurized olefins and the like; phosphorus-based extreme pressure agents, such as phosphoric acid esters (e.g., tricresyl phosphate (TCP) and the like), phosphorous acid esters, phosphoric acid ester amine salts, phosphorous acid ester amine salts, and the like; halogen-based extreme pressure agents, such as chlorinated hydrocarbons and the like; organometallic extreme pressure agents, such as thiophosphoric acid salts (e.g., zinc dithiophosphate (ZnDTP) and the like) and thiocarbamic acid salts; and the like can be used. As the anti-wear agent, organomolybdenum compounds such as molybdenum dithiophosphate (MoDTP), molybdenum dithiocarbamate (MoDTC) and the like; organoboric compounds such as alkylmercaptyl borate and the like; solid lubricant anti-wear agents such as graphite, molybdenum disulfide, antimony sulfide, boron compounds, polytetrafluoroethylene and the like; and the like can be used.

The phosphoric acid ester, thiophosphoric acid ester, and amine salt thereof functions to enhance the lubricating performances, and can be selected from known compounds conventionally employed as extreme pressure agents. Generally employed are phosphoric acid esters, a thiophosphoric acid ester, or an amine salt thereof which has an alkyl group, an alkenyl group, an alkylaryl group, or an aralkyl group, any of which contains approximately 3 to 30 carbon atoms.

Examples of the phosphoric acid esters include aliphatic phosphoric acid esters such as triisopropyl phosphate, tributyl phosphate, ethyl dibutyl phosphate, trihexyl phosphate, tri-2-ethylhexyl phosphate, trilauryl phosphate, tristearyl phosphate, and trioleyl phosphate; and aromatic phosphoric acid esters such as benzyl phenyl phosphate, allyl diphenyl phosphate, triphenyl phosphate, tricresyl phosphate, ethyl diphenyl phosphate, cresyl diphenyl phosphate, dicresyl phenyl phosphate, ethylphenyl diphenyl phosphate, diethylphenyl phenyl phosphate, propylphenyl diphenyl phosphate, dipropylphenyl phenyl phosphate, triethylphenyl phosphate, tripropylphenyl phosphate, butylphenyl diphenyl phosphate, dibutylphenyl phenyl phosphate, and tributylphenyl phosphate. Preferably, the phosphoric acid ester is a trialkylphenyl phosphate.

Examples of the thiophosphoric acid esters include aliphatic thiophosphoric acid esters such as triisopropyl thiophosphate, tributyl thiophosphate, ethyl dibutyl thiophosphate, trihexyl thiophosphate, tri-2-ethylhexyl thiophosphate, trilauryl thiophosphate, tristearyl thiophosphate, and trioleyl thiophosphate; and aromatic thiophosphoric acid esters such as benzyl phenyl thiophosphate, allyl diphenyl thiophosphate, triphenyl thiophosphate, tricresyl thiophosphate, ethyl diphenyl thiophosphate, cresyl diphenyl thiophosphate, dicresyl phenyl thiophosphate, ethylphenyl diphenyl thiophosphate, diethylphenyl phenyl thiophosphate, propylphenyl diphenyl thiophosphate, dipropylphenyl phenyl thiophosphate, triethylphenyl thiophosphate, tripropylphenyl thiophosphate, butylphenyl diphenyl thiophosphate, dibutylphenyl phenyl thiophosphate, and tributylphenyl thiophosphate. Preferably, the thiophosphoric acid ester is a trialkylphenyl thiophosphate.

Also employable are amine salts of the above-mentioned phosphates and thiophosphates. Amine salts of acidic alkyl or aryl esters of the phosphoric acid and thiophosphoric acid are also employable. Preferably, the amine salt is an amine salt of trialkylphenyl phosphate or an amine salt of alkyl phosphate.

One or any combination of the compounds selected from the group consisting of a phosphoric acid ester, a thiophosphoric acid ester, and an amine salt thereof may be used.

The phosphorus acid ester and/or its amine salt function to enhance the lubricating performances, and can be selected from known compounds conventionally employed as extreme pressure agents. Generally employed are a phosphorus acid ester or an amine salt thereof which has an alkyl group, an alkenyl group, an alkylaryl group, or an aralkyl group, any of which contains approximately 3 to 30 carbon atoms.

Examples of the phosphorus acid esters include aliphatic phosphorus acid esters such as triisopropyl phosphite, tributyl phosphite, ethyl dibutyl phosphite, trihexyl phosphite, tri-2-ethylhexylphosphite, trilauryl phosphite, tristearyl phosphite, and trioleyl phosphite; and aromatic phosphorus acid esters such as benzyl phenyl phosphite, allyl diphenylphosphite, triphenyl phosphite, tricresyl phosphite, ethyl diphenyl phosphite, tributyl phosphite, ethyl dibutyl phosphite, cresyl diphenyl phosphite, dicresyl phenyl phosphite, ethylphenyl diphenyl phosphite, diethylphenyl phenyl phosphite, propylphenyl diphenyl phosphite, dipropylphenyl phenyl phosphite, triethylphenyl phosphite, tripropylphenyl phosphite, butylphenyl diphenyl phosphite, dibutylphenyl phenyl phosphite, and tributylphenyl phosphite. Also favorably employed are dilauryl phosphite, dioleyl phosphite, dialkyl phosphites, and diphenyl phosphite. Preferably, the phosphorus acid ester is a dialkyl phosphite or a trialkyl phosphite.

The phosphate salt may be derived from a polyamine. The polyamines include alkoxylated diamines, fatty polyamine diamines, alkylenepolyamines, hydroxy containing polyamines, condensed polyamines arylpolyamines, and heterocyclic polyamines. Commercially available examples of alkoxylated diamines include those amines where y in the above formula is one. Examples of these amines include Ethoduomeen T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylene diamines, propane diamines (1,2, or 1,3), and polyamine analogs of the above. Suitable commercial fatty polyamines are Duomeen C (N-coco-1,3-diaminopropane), Duomeen S (N-soya-1,3-diaminopropane), Duomeen T (N-tallow-1,3-diaminopropane), and Duomeen 0 (N-oleyl-1,3-diaminopropane). "Duomeens" are commercially available from Armak Chemical Co., Chicago, Ill.

Such alkylenepolyamines include methylenepolyamines, ethylenepolyamines, butylenepolyamines, propylenepolyamines, pentylenepolyamines, and the like. The higher homologs and related heterocyclic amines such as piperazines and N-amino alkyl-substituted piperazines are also included. Specific examples of such polyamines are ethylenediamine, triethylenetetramine, tris-(2-aminoethyl)amine, propylenediamine, trimethylenediamine, tripropylenetetramine, tetraethylenepentamine, hexaethyleneheptamine, pentaethylenehexamine, and the like. Higher homologs obtained by condensing two or more of the above-noted alkyleneamines are similarly useful as are mixtures of two or more of the aforedescribed polyamines.

In one embodiment the polyamine is an ethylenepolyamine. Such polyamines are described in detail under the heading Ethylene Amines in Kirk Othmer's "Encyclopedia of Chemical Technology", 2d Edition, Vol. 7, pages 22-37, Interscience Publishers, New York (1965). Ethylenepolyamines are often a complex mixture of polyalkylenepolyamines including cyclic condensation products.

Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below 200° C. A typical sample of such ethylene polyamine bottoms obtained from the Dow Chemical Company of Freeport, Tex. designated "E-100". These alkylenepolyamine bottoms include cyclic condensation products such as piperazine and higher analogs of diethylenetriamine, triethylenetetramine and the like. These alkylenepolyamine bottoms can be reacted solely with the acylating agent or they can be used with other amines, polyamines, or mixtures thereof. Another useful polyamine is a condensation reaction between at least one hydroxy compound with at least one polyamine reactant containing at least one primary or secondary amino group. The hydroxy compounds are preferably polyhydric alcohols and amines. In one embodiment, the hydroxy compounds are polyhydric amines. Polyhydric amines include any of the above-described monoamines reacted with an alkylene oxide (e.g., ethylene oxide, propylene oxide, butylene oxide, and the like) having from two to 20 carbon atoms, or from two to four. Examples of polyhydric amines include tri-(hydroxypropyl)amine, tris-(hydroxymethyl)amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine, preferably tris(hydroxymethyl)aminomethane (THAM).

Polyamines which react with the polyhydric alcohol or amine to form the condensation products or condensed amines are described above. Preferred polyamines include triethylenetetramine (TETA), tetraethylenepentamine (TEPA), pentaethylenehexamine (PEHA), and mixtures of polyamines such as the above-described "amine bottoms".

Examples of extreme pressure additives include sulfur-based extreme pressure additives such as dialkyl sulfides, dibenzyl sulfide, dialkyl polysulfides, dibenzyl disulfide, alkyl mercaptans, dibenzothiophene and 2,2'-dithiobis(benzothiazole); phosphorus-based extreme pressure additives such as trialkyl phosphates, triaryl phosphates, trialkyl phosphonates, trialkyl phosphites, triaryl phosphites and dialkylhydrozine phosphites, and phosphorus- and sulfur-based extreme pressure additives such as zinc dialkyldithiophosphates, dialkylthiophosphoric acid, trialkyl thiophosphate esters, acidic thiophosphate esters and trialkyl trithiophosphates. These extreme pressure additives can be used individually or in the form of mixtures, conveniently in an amount within the range from 0.1 to 2 parts by weight, per 100 parts by weight of the base oil.

All the above can be performance enhanced using a variety of cobase stocks. AN, AB, ADPO, ADPS, ADPM, and/or a variety of mono-basic, di-basic, and tribasic esters in conjunction with low sulfur, low aromatic, low iodine number, low Bromine Number, high aniline point, isoparaffin.

In the above detailed description, the specific embodiments of this disclosure have been described in connection with its preferred embodiments. However, to the extent that the above description is specific to a particular embodiment or a particular use of this disclosure, this is intended to be illustrative only and merely provides a concise description of the exemplary embodiments. Accordingly, the disclosure is not limited to the specific embodiments described above, but rather, the disclosure includes all alternatives, modifications, and equivalents falling within the true scope of the appended claims. Various modifications and variations of this disclosure will be obvious to a worker skilled in the art and it is to be understood that such modifications and variations are to be included within the purview of this application and the spirit and scope of the claims. The following are examples of the present disclosure and are not to be construed as limiting.

EXAMPLES

Example 1

Reaction of mPAO ($Kv_{100}$: 336 cSt) with 1-octanethiol

To a round bottom flask equipped with a stir bar, mPAO ($Kv_{100}$: 336 cSt, 10 g) was mixed with 1-octanethiol (0.491 g. FW 146.29, 3.3 mmol) and the mixture was heated to 80° C. under nitrogen flow for 16 hours. 2,2'-Azobis(2-methylpropionitrile) (AIBN, FW 164.21, 0.138 g, 0.84 mmol) and toluene (2 g) were then added. The mixture was heated to 80° C. under nitrogen flow for 22 hours, after which the mixture was stripped under high vacuum to remove toluene and unreacted octanethiol. NMR analysis showed that the product contained less unsaturation and the thiol adduct had formed. FIG. 1 shows the reaction of a high viscosity mPAO with an alkyl thiol. The table in FIG. 3 includes data generated from Example 1.

Example 2

Reaction of mPAO ($Kv_{100}$: 636 cSt) with 1-octanethiol

To a round bottom flask equipped with a stir bar, mPAO ($Kv_{100}$: 636 cSt, 10 g) was mixed with 1-octanethiol (0.453 g. FW 146.29, 3.1 mmol), 2,2'-Azobis(2-methylpropionitrile) (AIBN, FW 164.21, 0.127 g, 0.77 mmol) and toluene (2 g) and the mixture was heated to 80° C. under nitrogen flow for 19 hours, after which the mixture was stripped under high vacuum to remove toluene and unreacted octanethiol. NMR analysis showed that the product contained less unsaturation and the thiol adduct had formed. DSC data (heating in air) of the fluid of Example 2 showed that oxidation of product of the Example 2 occurs at 233.3° C. compared to starting mPAO which occurs at 188.8° C. Thus, there is a substantial improvement in oxidation stability of mPAO. FIG. 1 shows the reaction of a high viscosity mPAO with an alkyl thiol. The table in FIG. 3 includes data generated from Example 2.

Example 3

Reaction of mPAO ($Kv_{100}$: 1089 cSt) with 1-octanethiol

To a round bottom flask equipped with a stir bar, mPAO ($Kv_{100}$: 1089 cSt, 10 g) was mixed with 1-octanethiol (0.351 g, FW 146.29, 2.4 mmol), 2,2'-Azobis(2-methylpropionitrile) (0.098 g AIBN, FW 164.21, 0.60 mmol) and toluene (2 g) and the mixture was heated to 80° C. under nitrogen flow for 17 hours, after which the mixture was stripped under high vacuum to remove toluene and unreacted octanethiol. NMR analysis showed that the product contained less unsaturation and the thiol adduct had formed. DSC data (heating in air) of the fluid of Example 3 showed that oxidation of product of the Example 3 occurs at 224.1° C. compared to starting mPAO which occurs at 190.4° C. Thus, there is a substantial improvement in oxidation stability of mPAO. FIG. 1 shows the reaction of a high viscosity mPAO with an alkyl thiol. The table in FIG. 3 includes data generated from Example 3.

Example 4

Alkylation of mPAO 336 Set with Diphenyl Amine in Presence of Using 1-ethyl-3-methyl Imidazolium Heptachloroaluminate Charge the mPAO 336 cSt (2.0 g, 0.00034 mol), diphenylamine (0.088 g, 0.00051 mole) and 5 ml decane in 25 ml thick glass reactor under $N_2$ atmosphere. Slowly added 0.5 g freshly prepared 1-ethyl-3-methylimidazolium heptachloroaluminate at room temperature. After addition, the reaction mixture was stir for 18 h at 115° C. Stopped the reaction by adding 2.0 ml water and 5.0 ml toluene. The product was washed with (1×2.5 ml) saturated $NaHCO_3$ and brine solution (1×2.5 ml) until, the aqueous layer pH ~7. The low boiling (toluene) component removed by rotavapory and high boiling component (decane) by air bath oven at 180° C. under vacuum for 1 h. The excess of diphenylamine was removed by washing with methanol. Yield: 1.8 g (~90%).

Figure 2:
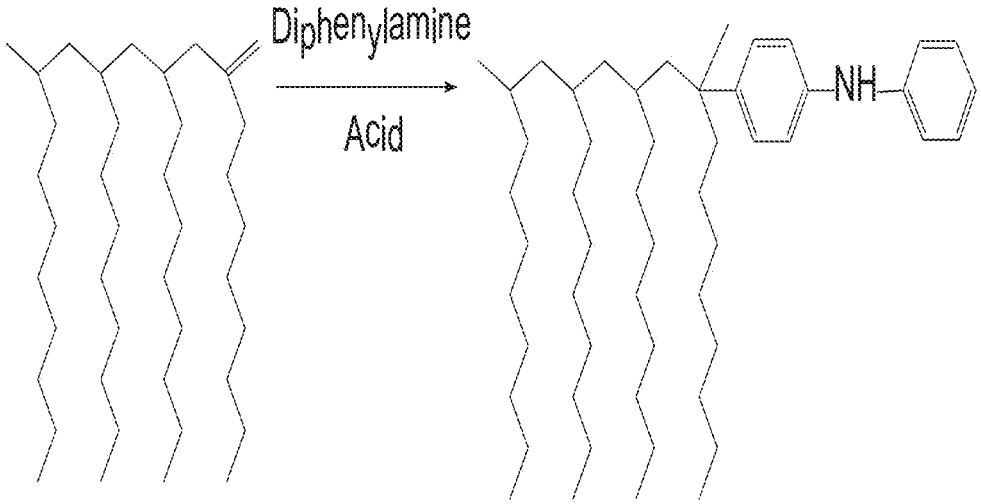
FIG. 2 depicts the reaction of a high viscosity mPAO with diphenylamine.

The analysis of IR and $^1$H NMR of the product conformed that the mPAO vinyl group had completely undergone alkylation with diphenylamine. IR: ($cm^{-1}$) 3392, 2956, 2923, 2853, 1612, 1454, 1352, 1312, and 716. $^1$H NMR (400 MHz; $CDCl_3$): δ (ppm)=0.90 (t, $CH_3$), 1.09-1.25 (m, —$CH_2$—), 5.75 (s. HN<), 6.93-7.51 (m, phenyl). FIG. 2 shows the reaction of a high viscosity mPAO with diphenylamine. The table in FIG. 3 includes data generated from Example 4.

Pressure Differential Scanning Calorimetry (PDSC)

PDSC is a useful screening tool for measuring oxidative stability. PDSC is used to determine oxidation under heating conditions. A heating experiment measures the temperature at which oxidation initiates under oxygen pressure. A DSC Model 2920 (TA instruments) with a pressure cell was used for the measurements. The cell is well calibrated for temperature (+/−0.3° C.) and heat flow (better than 1%) and checked for reproducibility daily with a QC standard for temperature and heat response. The heating measurements were carried out at a heating rate of 10° C./minute using pressure of 100 psi in air. DSC data (heating in air) of the fluid of Example 1 showed that oxidation of product of the Example 1 occurs at 242.3° C. compared to starting mPAO which occurs at 195.4° C. Thus, there is a substantial improvement in oxidation stability of the mPAO.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A process for producing a functionalized metallocene polyalphaolefin (mPAO) fluid, said process comprising:

providing a mPAO having a terminal double bond, said mPAO produced by the metallocene-catalyzed oligomerization or polymerization of an alpha-olefin feed, providing at least one of a substituted or unsubstituted alkyl thiol, aryl thiol, diphenylamine; and reacting, optionally in the presence of a catalyst or initiator, the mPAO having a terminal double bond with at least one of the substituted or unsubstituted alkyl thiol, aryl thiol, diphenylamine, under reaction conditions sufficient to produce the functionalized mPAO fluid;

wherein the functionalized mPAO fluid has a viscosity ($Kv_{100}$) from 135 to 900 cSt at 100° C.; a viscosity index (VI) greater than 150; a pour point (PP) less than −25° C.; a molecular weight distribution (Mw/Mn) less than 2.0; a residual unsaturation (Bromine Number) less than 2.0; and a glass transition temperature $T_g$ less than −30° C.

2. The process of claim 1 wherein the functionalized mPAO fluid has an oxidative stability, as determined by Pressure Differential Scanning Calorimetry (PDSC), at least 1.10× greater than oxidative stability of an as synthesized mPAO that has not been hydrogenated.

3. The process of claim 1 wherein the functionalized mPAO fluid has an as-synthesized Bromine Number of 1.8 or less.

4. The process of claim 1 wherein the functionalized mPAO fluid has an as-synthesized Bromine Number of 1.4 or less.

5. The process of claim 1 wherein the functionalized mPAO fluid has, as synthesized, a viscosity ($Kv_{100}$) from 150 to 900 cSt at 100° C.; a viscosity index (VI) greater than 200; a pour point (PP) less than −30° C.; a molecular weight distribution (Mw/Mn) less than 1.90; a residual unsaturation (Bromine Number) less than 1.8; and a glass transition temperature $T_g$ less than −40° C.

6. The process of claim 1 wherein the functionalized mPAO fluid comprises a lubricating oil base stock or co-base stock.

7. A method for improving oxidative stability of a metallocene polyalphaolefin (mPAO) fluid, said method comprising:

providing a mPAO having a terminal double bond, said mPAO produced by the metallocene-catalyzed oligomerization or polymerization of an alpha-olefin feed, providing at least one of a substituted or unsubstituted alkyl thiol, aryl thiol, diphenylamine; and reacting, optionally in the presence of a catalyst or initiator, the mPAO having a terminal double bond with at least one of the substituted or unsubstituted alkyl thiol, aryl thiol, diphenylamine, under reaction conditions sufficient to produce a functionalized mPAO fluid;

wherein the functionalized mPAO fluid has, as synthesized, a viscosity ($Kv_{100}$) from 135 to 900 cSt at 100° C.; a viscosity index (VI) greater than 150; a pour point (PP) less than −25° C.; a molecular weight distribution (Mw/Mn) less than 2.0; a residual unsaturation (Bromine Number) less than 2.0; and a glass transition temperature $T_g$ less than −30° C.

8. The method of claim 7 wherein the functionalized mPAO fluid has an oxidative stability, as determined by Pressure Differential Scanning Calorimetry (PDSC), at least 1.10× greater than oxidative stability of an as synthesized mPAO that has not been hydrogenated.

9. The method of claim 7 wherein the functionalized mPAO fluid has an as-synthesized Bromine Number of 1.8 or less.

10. The method of claim 7 wherein the functionalized mPAO fluid has an as-synthesized Bromine Number of 1.4 or less.

11. The method of claim 7 wherein the functionalized mPAO fluid has, as synthesized, a viscosity ($Kv_{100}$) from 150 to 900 cSt at 100° C.; a viscosity index (VI) greater than 200; a pour point (PP) less than −30° C.; a molecular weight distribution (Mw/Mn) less than 1.90; a residual unsaturation (Bromine Number) less than 1.8; and a glass transition temperature $T_g$ less than −40° C.

12. The method of claim 7 wherein the functionalized mPAO fluid comprises a lubricating oil base stock or co-base stock.

13. A functionalized metallocene polyalphaolefin (mPAO) fluid prepared by the process of claim 1.

14. The functionalized metallocene polyalphaolefin (mPAO) fluid of claim 13 which has an oxidative stability, as determined by Pressure Differential Scanning Calorimetry (PDSC), at least 1.10× greater than oxidative stability of an as synthesized mPAO that has not been hydrogenated.

15. The functionalized metallocene polyalphaolefin (mPAO) fluid of claim 13 which comprises a lubricating oil base stock or co-base stock.

16. The functionalized metallocene polyalphaolefin (mPAO) fluid of claim 13 which has a kinematic viscosity at 100° C. of 300 to 800 cSt, an as-synthesized Mw/Mn of 1.9 or less, and an as-synthesized Bromine Number of less than 1.9.

17. A functionalized metallocene polyalphaolefin (mPAO) base stock or co-base stock prepared by the process of claim 1.

18. A lubricating oil comprising (i) a base stock comprising the functionalized metallocene polyalphaolefin (mPAO) base stock of claim 17, or (ii) a conventional base stock and a co-base stock, wherein the co-base stock comprises the functionalized metallocene polyalphaolefin (mPAO) base stock of claim 17.

19. The lubricating oil of claim 18 wherein the lubricating oil base stock is present in an amount from 85 weight percent to 99 weight percent, based on the total weight of the lubricating oil.

20. The lubricating oil of claim 18 wherein the lubricating oil further comprises one or more of a viscosity improver, antioxidant, detergent, dispersant, pour point depressant, corrosion inhibitor, metal deactivator, seal compatibility additive, anti-foam agent, inhibitor, and anti-rust additive.

* * * * *